US008902150B2

(12) United States Patent
Kurita

(10) Patent No.: US 8,902,150 B2
(45) Date of Patent: Dec. 2, 2014

(54) LIGHTING SYSTEM AND CALIBRATION METHOD THEREFOR

(71) Applicant: Canon Kabushiki Kaisha, Tokyo (JP)

(72) Inventor: Masanao Kurita, Isehara (JP)

(73) Assignee: Canon Kabushiki Kaisha, Tokyo (JP)

( * ) Notice: Subject to any disclaimer, the term of this patent is extended or adjusted under 35 U.S.C. 154(b) by 84 days.

(21) Appl. No.: 13/800,590

(22) Filed: Mar. 13, 2013

(65) Prior Publication Data

US 2013/0257290 A1 Oct. 3, 2013

(30) Foreign Application Priority Data

Mar. 30, 2012 (JP) ..... 2012-080967

(51) Int. Cl.

| | |
|---|---|
| ***G09G 3/36*** | (2006.01) |
| ***G09G 3/34*** | (2006.01) |
| ***H05B 33/08*** | (2006.01) |
| ***H05B 37/02*** | (2006.01) |

(52) U.S. Cl.

CPC ..... *H05B 37/02* (2013.01); *G09G 2320/043* (2013.01); *G09G 2320/0233* (2013.10); *G09G 2320/0626* (2013.01); *G09G 2320/0693* (2013.01); *G09G 3/3426* (2013.01); *H05B 33/0869* (2013.01); *G09G 2360/145* (2013.01)

USPC ..... 345/102; 345/103; 315/151; 315/152; 315/192; 315/291; 315/294; 349/61; 349/71

(58) Field of Classification Search

USPC ..... 315/151, 152, 192, 291, 294; 345/102, 345/103; 349/61, 71

See application file for complete search history.

(56) References Cited

U.S. PATENT DOCUMENTS

| | | | | |
|---|---|---|---|---|
| 7,067,995 | B2 * | 6/2006 | Gunter et al. | 315/312 |
| 2009/0277889 | A1 * | 11/2009 | Kobayashi et al. | 219/121.67 |
| 2010/0315323 | A1 * | 12/2010 | Cennini et al. | 345/102 |

FOREIGN PATENT DOCUMENTS

| | | |
|---|---|---|
| JP | 2001-142409 | 5/2001 |
| WO | 2008-029548 | 3/2008 |

* cited by examiner

*Primary Examiner* — Douglas W Owens
*Assistant Examiner* — Thai Pham
(74) *Attorney, Agent, or Firm* — Cowan, Liebowitz & Latman, P.C.

(57) ABSTRACT

A lighting apparatus has a plurality of light emission block group and a detection unit for each light emission block group, wherein light emission blocks selected from different light emission block groups are grouped as sets, and light emission blocks belonging to a same set are caused to emit light simultaneously. The grouping is such that a minimum value, in all the sets, of a detection value ratio becomes as large as possible, wherein the detection value ratio is a ratio between an amount of light due to a light emission from one light emission block belonging to a light emission block group corresponding to each detection unit, and an amount of light due to a light emission from another light emission block emitting light simultaneously with the one light emission block.

11 Claims, 17 Drawing Sheets

| ORDER OF DETECTION | 200 LIGHT EMISSION BLOCK A | 201 OPTICAL SENSOR FOR DETECTION OF LIGHT EMISSION BLOCK A | 202 LIGHT EMISSION BLOCK B | 203 OPTICAL SENSOR FOR DETECTION OF LIGHT EMISSION BLOCK B |
|---|---|---|---|---|
| 1 | 111(1,1,1) | 113(1,1) | 111(1,2,4) | 113(1,2) |
| 2 | 111(1,1,2) | | 111(1,2,1) | |
| 3 | 111(1,1,3) | | 111(1,2,2) | |
| 4 | 111(1,1,4) | | 111(1,2,3) | |
| 5 | 111(1,1,5) | | 111(1,2,8) | |
| 6 | 111(1,1,6) | | 111(1,2,5) | |
| 7 | 111(1,1,7) | | 111(1,2,6) | |
| 8 | 111(1,1,8) | | 111(1,2,7) | |
| 9 | 111(2,1,1) | 113(2,1) | 111(2,2,4) | 113(2,2) |
| 10 | 111(2,1,2) | | 111(2,2,1) | |
| 11 | 111(2,1,3) | | 111(2,2,2) | |
| 12 | 111(2,1,4) | | 111(2,2,3) | |
| 13 | 111(2,1,5) | | 111(2,2,8) | |
| 14 | 111(2,1,6) | | 111(2,2,5) | |
| 15 | 111(2,1,7) | | 111(2,2,6) | |
| 16 | 111(2,1,8) | | 111(2,2,7) | |
| 17 | 111(3,1,1) | 113(3,1) | 111(3,2,4) | 113(3,2) |
| 18 | 111(3,1,2) | | 111(3,2,1) | |
| 19 | 111(3,1,3) | | 111(3,2,2) | |
| 20 | 111(3,1,4) | | 111(3,2,3) | |
| 21 | 111(3,1,5) | | 111(3,2,8) | |
| 22 | 111(3,1,6) | | 111(3,2,5) | |
| 23 | 111(3,1,7) | | 111(3,2,6) | |
| 24 | 111(3,1,8) | | 111(3,2,7) | |

*Fig.4*

| ORDER OF DETECTION | 200 LIGHT EMISSION BLOCK A | 201 OPTICAL SENSOR FOR DETECTION OF LIGHT EMISSION BLOCK A | 202 LIGHT EMISSION BLOCK B | 203 OPTICAL SENSOR FOR DETECTION OF LIGHT EMISSION BLOCK B | 204 DETECTION VALUE RATIO Rv FOR LIGHT EMISSION BLOCK A | 205 DETECTION VALUE RATIO Rv FOR LIGHT EMISSION BLOCK B |
|---|---|---|---|---|---|---|
| 1 | 111(1,1,1) | 113(1,1) | 111(1,2,4) | 113(1,2) | 10.1 | 10.1 |
| 2 | 111(1,1,2) | | 111(1,2,1) | | 2.1 | 6.6 |
| 3 | 111(1,1,3) | | 111(1,2,2) | | 5.6 | 5.6 |
| 4 | 111(1,1,4) | | 111(1,2,3) | | 6.6 | 2.1 |
| 5 | 111(1,1,5) | | 111(1,2,8) | | 10.1 | 10.1 |
| 6 | 111(1,1,6) | | 111(1,2,5) | | 2.1 | 6.6 |
| 7 | 111(1,1,7) | | 111(1,2,6) | | 5.6 | 5.6 |
| 8 | 111(1,1,8) | | 111(1,2,7) | | 6.6 | 2.1 |
| 9 | 111(2,1,1) | 113(2,1) | 111(2,2,4) | 113(2,2) | 10.1 | 10.1 |
| 10 | 111(2,1,2) | | 111(2,2,1) | | 2.1 | 6.6 |
| 11 | 111(2,1,3) | | 111(2,2,2) | | 5.6 | 5.6 |
| 12 | 111(2,1,4) | | 111(2,2,3) | | 6.6 | 2.1 |
| 13 | 111(2,1,5) | | 111(2,2,8) | | 10.1 | 10.1 |
| 14 | 111(2,1,6) | | 111(2,2,5) | | 2.1 | 6.6 |
| 15 | 111(2,1,7) | | 111(2,2,6) | | 5.6 | 5.6 |
| 16 | 111(2,1,8) | | 111(2,2,7) | | 6.6 | 2.1 |
| 17 | 111(3,1,1) | 113(3,1) | 111(3,2,4) | 113(3,2) | 10.1 | 10.1 |
| 18 | 111(3,1,2) | | 111(3,2,1) | | 2.1 | 6.6 |
| 19 | 111(3,1,3) | | 111(3,2,2) | | 5.6 | 5.6 |
| 20 | 111(3,1,4) | | 111(3,2,3) | | 6.6 | 2.1 |
| 21 | 111(3,1,5) | | 111(3,2,8) | | 10.1 | 10.1 |
| 22 | 111(3,1,6) | | 111(3,2,5) | | 2.1 | 6.6 |
| 23 | 111(3,1,7) | | 111(3,2,6) | | 5.6 | 5.6 |
| 24 | 111(3,1,8) | | 111(3,2,7) | | 6.6 | 2.1 |

*Fig.5*

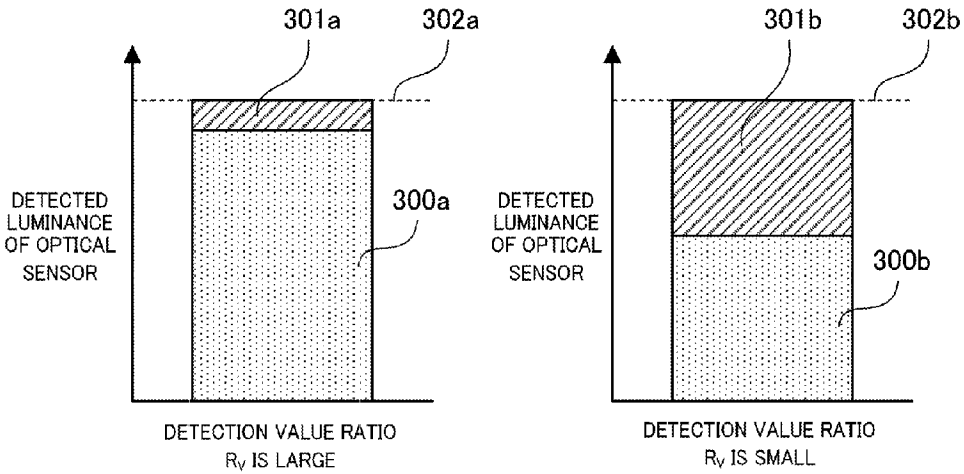
Fig.7A
Fig.7B
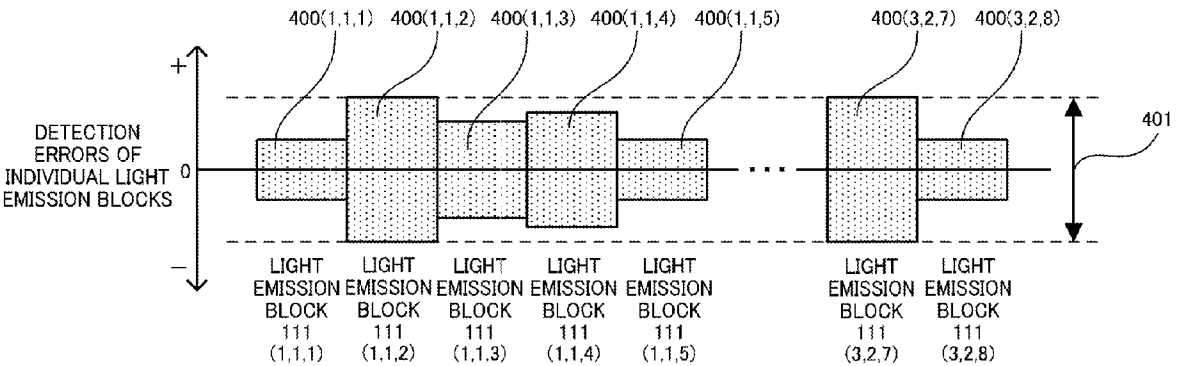
Fig.7C

| 500 ORDER OF DETECTION | 501 LIGHT EMISSION BLOCK A | 502 OPTICAL SENSOR FOR DETECTION OF LIGHT EMISSION BLOCK A | 503 LIGHT EMISSION BLOCK B | 504 OPTICAL SENSOR FOR DETECTION OF LIGHT EMISSION BLOCK B |
|---|---|---|---|---|
| 1 | 111(1,1,1) | 113(1,1) | 111(1,3,2) | 113(1,3) |
| 2 | 111(1,1,2) | | 111(1,3,1) | |
| 3 | 111(1,1,3) | | 111(1,3,4) | |
| 4 | 111(1,1,4) | | 111(1,3,3) | |
| 5 | 111(1,2,1) | 113(1,2) | 111(1,4,2) | 113(1,4) |
| 6 | 111(1,2,2) | | 111(1,4,1) | |
| 7 | 111(1,2,3) | | 111(1,4,4) | |
| 8 | 111(1,2,4) | | 111(1,4,3) | |
| 9 | 111(2,1,1) | 113(2,1) | 111(2,3,2) | 113(2,3) |
| 10 | 111(2,1,2) | | 111(2,3,1) | |
| 11 | 111(2,1,3) | | 111(2,3,4) | |
| 12 | 111(2,1,4) | | 111(2,3,3) | |
| 13 | 111(2,2,1) | 113(2,2) | 111(2,4,2) | 113(2,4) |
| 14 | 111(2,2,2) | | 111(2,4,1) | |
| 15 | 111(2,2,3) | | 111(2,4,4) | |
| 16 | 111(2,2,4) | | 111(2,4,3) | |
| 17 | 111(3,1,1) | 113(3,1) | 111(3,3,2) | 113(3,3) |
| 18 | 111(3,1,2) | | 111(3,3,1) | |
| 19 | 111(3,1,3) | | 111(3,3,4) | |
| 20 | 111(3,1,4) | | 111(3,3,3) | |
| 21 | 111(3,2,1) | 113(3,2) | 111(3,4,2) | 113(3,4) |
| 22 | 111(3,2,2) | | 111(3,4,1) | |
| 23 | 111(3,2,3) | | 111(3,4,4) | |
| 24 | 111(3,2,4) | | 111(3,4,3) | |

*Fig.14*

LIGHTING SYSTEM AND CALIBRATION METHOD THEREFOR

BACKGROUND OF THE INVENTION

1. Field of the Invention

The present invention relates to a lighting apparatus and a calibration method therefor.

2. Description of the Related Art

In general, a color image display apparatus includes a color liquid crystal panel having light filters, and a backlight apparatus which is alighting apparatus for irradiating white light to a back surface of the color liquid crystal panel.

In the past, as light sources for backlight apparatus, fluorescent lamps such as cold cathode fluorescent lamps (CCFL: Cold Cathode Fluorescent Lamps), etc., have mainly been used. However, in recent years, light emitting diodes (LED: Light Emitting Diodes), which are advantageous in respect of electric power consumption, life span, color reproducibility, and environmental impact, are becoming increasingly used as light sources of backlight apparatus.

A backlight apparatus using LEDs as a light source (LED backlight apparatus) is generally composed of a lot of LEDs. Japanese patent application laid-open No. 2001-142409 discloses an LED backlight apparatus which is constructed such that it is divided into a plurality of light emission blocks, each of which is composed of one or more LEDs, wherein brightness control is carried out on these light emission blocks independently of one another. The electric power consumption of the LED backlight apparatus is decreased and the contrast of an image is improved, by reducing the brightnesses of those light emission blocks which irradiate light on those areas of a color liquid crystal panel in which a dark image is displayed, among all the display areas thereof. Such brightness control for each light emission block according to the content of a displayed image is referred to as local dimming control.

On the other hand, when brightness control for each light emission block is carried out by means of local dimming control, there will be a problem of unevenness in brightness of the LED backlight apparatus as a whole. One factor for this problem is that temperature variation among the light emission blocks is caused by the brightness control for each light emission block, so that the brightness of each light emission block varies due to the temperature characteristics of the LEDs. Another factor is that variation in the extent of aged deterioration among the light emission blocks is caused due to the brightness control for each light emission block, thus resulting in brightness variation.

As a technique of reducing the brightness unevenness generated due to such variation in temperature among the light emission blocks and in the extent of aged deterioration, there is known a technique of detecting and correcting the brightness of each light emission block by means of an optical sensor in a state where the individual light emission blocks are caused to turn on in a sequential manner.

In international laid-open publication No. 2008/029548, the time required to carry out the calibration of an LED backlight apparatus is made shorter, by detecting the brightnesses of individual light emission blocks at the same time with the use of a plurality of optical sensors in a state where the plurality of light emission blocks, which are arranged at an interval d apart from each other, are caused to turn on at the same time.

SUMMARY OF THE INVENTION

In the above-mentioned conventional technique, there has been a case where the calibration could not be carried out with sufficient accuracy. That is because detection errors resulting from the fact that lights emitted from the light emission blocks which emit the lights at the same time enter each optical sensor as leakage light may become large, depending on the positional relationship of each of the plurality of optical sensors and each of the plurality of light emission blocks which emit the lights at the same time.

In particular, when the number of the optical sensors is smaller with respect to the number of the light emission blocks, there has been a case where the detection errors as referred to above become large.

Accordingly, the present invention is intended to provide a technique which is capable of suppressing reduction in accuracy of calibration, in cases where the calibration is carried out, while causing a plurality of light emission blocks to emit light at the same time in a lighting apparatus which is composed of a plurality of light emission blocks, of which the emissions of light can be controlled independently of one another.

A first aspect of the present invention resides in a lighting apparatus which comprises:

a plurality of light emission block groups composed of a plurality of light emission blocks, the emissions of light of which are able to be controlled independently of one another; and a detection unit that is provided for each of said light emission block groups, and detects a light emission characteristic of each of light emission blocks which belong to the corresponding light emission block group;

wherein said plurality of light emission blocks are grouped in such a manner that sets of light emission blocks are formed, each one of which is selected from a plurality of different light emission block groups, with all said light emission blocks being included in any of the sets;

an obtaining unit is provided which carries out control on all the sets in a sequential manner, such that a plurality of light emission blocks belonging to a same set are caused to emit light at the same time, and a light emission characteristic of each of those light emission blocks which are caused to emit light at the same time is obtained by a detection unit corresponding to a light emission block group to which each of the light emission blocks emitting light at the same time belongs; and said grouping is decided in such a manner that a minimum value, in all the sets, of a detection value ratio becomes as large as possible, wherein the detection value ratio is a ratio between an amount of light, of the total amount of light which is received by each of said detection units at the time when the plurality of light emission blocks belonging to the same set emit light at the same time, due to an emission of light from a light emission block belonging to a light emission block group corresponding to each of said detection units, and an amount of light, of said total amount of light, due to an emission of light from another light emission block which emits light simultaneously with said light emission block.

A second aspect of the present invention resides in a lighting apparatus which comprises:

a plurality of light emission block groups composed of a plurality of light emission blocks, the emissions of light of which are able to be controlled independently of one another; and a detection unit group that is provided for each of said light emission block groups, and is composed of a plurality of detection units for detecting light emission characteristics of light emission blocks which belong to the corresponding light emission block group;

wherein said plurality of light emission blocks are grouped in such a manner that sets of light emission blocks are formed, each one of which is selected from a plurality of different light emission block groups, with all said light emission blocks being included in any of the sets;

an obtaining unit is provided which carries out control on all the sets in a sequential manner, such that a plurality of light emission blocks belonging to a same set are caused to emit light at the same time, and a light emission characteristic of each of those light emission blocks which are caused to emit light at the same time is obtained by a detection unit which is the nearest to said light emission block, among a plurality of detection units belonging to a detection unit group corresponding to a light emission block group to which each of the light emission blocks emitting light at the same time belongs; and said grouping is decided in such a manner that a minimum value, in all the sets, of a detection value ratio becomes as large as possible, wherein the detection value ratio is a ratio between an amount of light, of a total amount of light which is received by each of said detection units, at the time when the plurality of light emission blocks belonging to the same set emit light at the same time, due to an emission of light from a light emission block belonging to a light emission block group corresponding to each of said detection units, and an amount of light, of said total amount of light, due to an emission of light from another light emission block which emits light simultaneously with said light emission block.

A third aspect of the present invention resides in a calibration method for a lighting apparatus which includes:

a plurality of light emission block groups composed of a plurality of light emission blocks, the emissions of light of which are able to be controlled independently of one another; and a detection unit that is provided for each of said light emission block groups, and detects a light emission characteristic of each of light emission blocks which belong to the corresponding light emission block group;

wherein said plurality of light emission blocks are grouped in such a manner that sets of light emission blocks are formed, each one of which is selected from a plurality of different light emission block groups, with all said light emission blocks being included in any of the sets;

said method comprising:

an obtaining step to carry out control on all the sets in a sequential manner, such that a plurality of light emission blocks belonging to a same set are caused to emit light at the same time, and a light emission characteristic of each of those light emission blocks which are caused to emit light at the same time is obtained by a detection unit corresponding to a light emission block group to which each of the light emission blocks emitting light at the same time belongs; and a calibration step to correct an amount of light emission of each light emission block based on a result of a comparison between a detected value of a light emission characteristic thereof obtained in said obtaining step and a target value thereof;

wherein said grouping is decided in such a manner that a minimum value, in all the sets, of a detection value ratio becomes as large as possible, wherein the detection value ratio is a ratio between an amount of light, of the total amount of light which is received by each of said detection units at the time when the plurality of light emission blocks belonging to the same set emit light at the same time, due to an emission of light from a light emission block belonging to a light emission block group corresponding to each of said detection units, and an amount of light, of said total amount of light, due to an emission of light from another light emission block which emits light simultaneously with said light emission block.

A fourth aspect of the present invention resides in a calibration method for a lighting apparatus which includes:

a plurality of light emission block groups composed of a plurality of light emission blocks, the emissions of light of which are able to be controlled independently of one another; and a detection unit group that is provided for each of said light emission block groups, and is composed of a plurality of detection units for detecting light emission characteristics of light emission blocks which belong to the corresponding light emission block group;

wherein said plurality of light emission blocks are grouped in such a manner that sets of light emission blocks are formed, each one of which is selected from a plurality of different light emission block groups, with all said light emission blocks being included in any of the sets;

said method comprising:

an obtaining step to carry out control on all the sets in a sequential manner, such that a plurality of light emission blocks belonging to a same set are caused to emit light at the same time, and a light emission characteristic of each of those light emission blocks which are caused to emit light at the same time is obtained by a detection unit which is the nearest to said light emission block, among a plurality of detection units belonging to a detection unit group corresponding to a light emission block group to which each of the light emission blocks emitting light at the same time belongs; and a calibration step to correct an amount of light emission of each light emission block based on a result of a comparison between a detected value of a light emission characteristic thereof obtained in said obtaining step and a target value thereof;

wherein said grouping is decided in such a manner that a minimum value, in all the sets, of a detection value ratio becomes as large as possible, wherein the detection value ratio is a ratio between an amount of light, of a total amount of light which is received by each of said detection units, at the time when the plurality of light emission blocks belonging to the same set emit light at the same time, due to an emission of light from a light emission block belonging to a light emission block group corresponding to each of said detection units, and an amount of light, of said total amount of light, due to an emission of light from another light emission block which emits light simultaneously with said light emission block.

According to the present invention, in a lighting apparatus composed of a plurality of light emission blocks of which the emissions of light are able to be controlled independently of one another, it is possible to suppress reduction in accuracy of calibration, in cases where the calibration is carried out while causing a plurality of light emission blocks to emit light at the same time.

Further features of the present invention will become apparent from the following description of exemplary embodiments with reference to the attached drawings.

BRIEF DESCRIPTION OF THE DRAWINGS

FIG. 4 shows an example of pairs of light emission blocks, each pair of which are caused to emit light at the same time.

FIG. 5 shows an example of actually measured values of a detection value ratio $R_V$ for each pair of light emission blocks which are caused to emit light at the same time.

FIGS. 7A, 7B and 7C are schematic views showing relations among a detection value ratio $R_V$, detection errors, and a brightness unevenness maximum value.

FIG. 14 is a view showing an example of pairs of light emission blocks to be lit or turned on at the same time, and an order of detection in the second embodiment of the present invention.

DESCRIPTION OF THE EMBODIMENTS

First Embodiment

Herein below, reference will be made to a backlight apparatus according to a first example of the present invention. This backlight apparatus is a lighting apparatus (a light emitting device) which is composed of a plurality of light emission blocks, the emissions of light of which are able to be controlled independently of one another, and the plurality of light emission blocks are grouped into a plurality of light emission block groups, each of which is composed of a plurality of light emission blocks. Here, note that the present invention is able to be applied to other lighting apparatus than a backlight apparatus of a liquid crystal display device. In addition, an image display apparatus according to the present invention is not limited to a liquid crystal display device provided with a liquid crystal panel as a display panel.

Figure 1A:
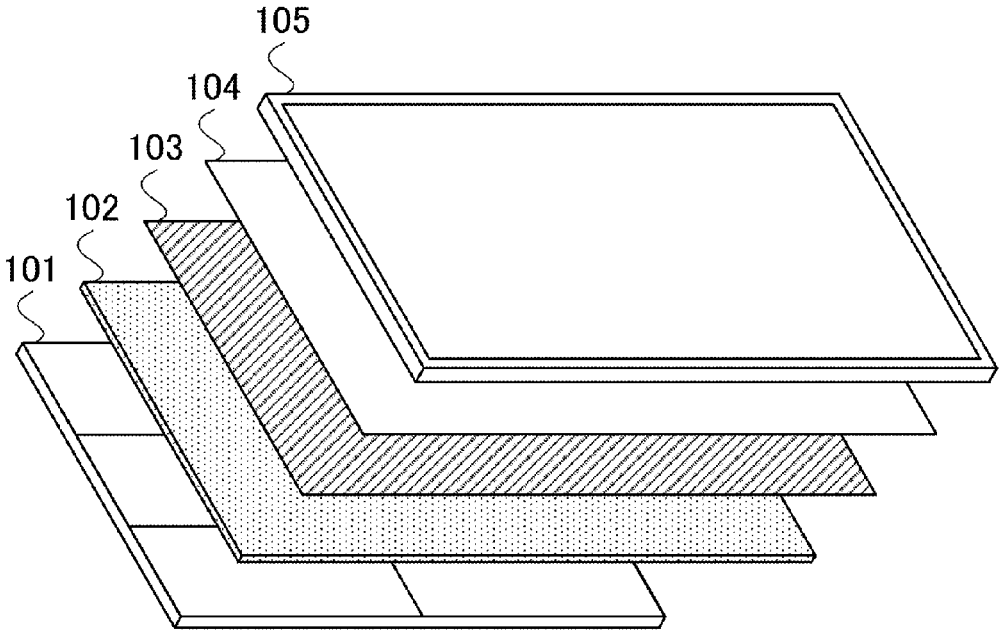
FIGS. 1A, 1B and 1C are schematic views showing an example of the construction of a color image display apparatus according to embodiments of the present invention.

FIG. 1A is a schematic view showing an example of the construction of a color image display apparatus, to which the present invention can be applied. The color image display apparatus has an LED backlight apparatus 101, a diffuser 102, a condensing sheet 103, a reflection type polarization film 104, and a color liquid crystal panel 105.

The LED backlight apparatus 101 is a backlight apparatus which irradiates a white light to a back face of the color liquid crystal panel 105. The LED backlight apparatus 101 has a plurality of LEDs (Light Emitting Diodes) which are point light sources. The diffuser 102 serves to operate the LED backlight apparatus 101 as a surface light source by diffusing light from the above-mentioned plurality of LEDs. The condensing sheet 103 improves the front brightness (luminance) of the color liquid crystal panel 105 by causing white light, which is diffused by the diffuser 102 and is incident thereto at various angles of incidence, to condense in a front direction (to a side of the color liquid crystal panel 105). The reflection type polarization film 104 improves the brightness displayed on the color liquid crystal panel 105 by polarizing the incident white light in an efficient manner. The color liquid crystal panel 105 displays a color image thereon by adjusting the transmittance of the irradiated white light for each pixel of RGB.

Figure 1B:
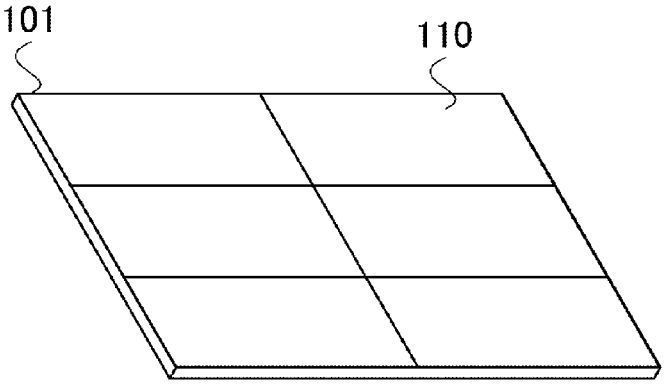

FIG. 1B is a schematic view showing an example of the construction of the LED backlight apparatus 101. The LED backlight apparatus 101 is constructed of a plurality of LED boards 110 which are arranged in a matrix form.

Figure 1C:
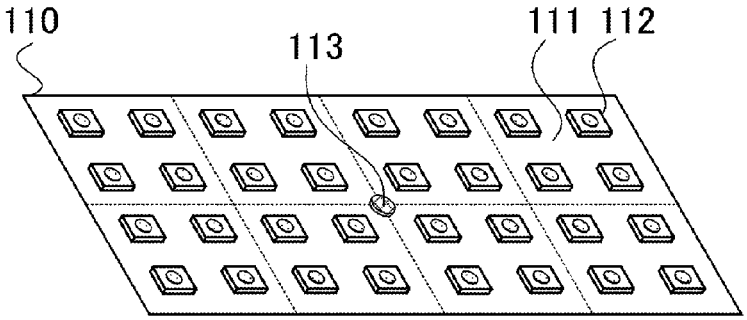

FIG. 1C is a schematic view showing an example of the construction of an LED board 110. The LED board 110 is composed of a total of eight (2×4) light emission blocks 111. Each light emission block 111 has four LED chips 112 which are arranged at equal intervals. The individual LED chips 112 are electrically connected in series to one another, so that brightness (intensity) control can be made for each light emission block 111 as one control unit. Each LED chip 112 may be composed of a white LED, or may instead be constructed by a combination of LEDs of multiple colors such as RGB (red, green and blue) which are combined so as to emit white color light.

Mounted on each LED board 110 is an optical sensor 113 which acts as a photodetection unit for detecting the light emission (luminescence) characteristics of the corresponding light emission blocks 111. As the optical sensor 113, there is used a sensor which is able to measure a change in the amount of light (brightness), such as a photo diode, a photo transistor, etc. In addition, as an optical sensor, there may be used a sensor which is able to detect at least either of brightness and chromaticity. Light emitted from each light emission block 111 enters a corresponding optical sensor 113, after being reflected by the diffuser 102 or the reflection type polarization film 104, so that a brightness change in each light emission block 111 is detected.

With the construction of this embodiment, there is one optical sensor with respect to eight light emission blocks 111. In order to suppress or reduce the cost and the circuit size, it is desirable that the number of optical sensors be small in this manner.

Figure 2:
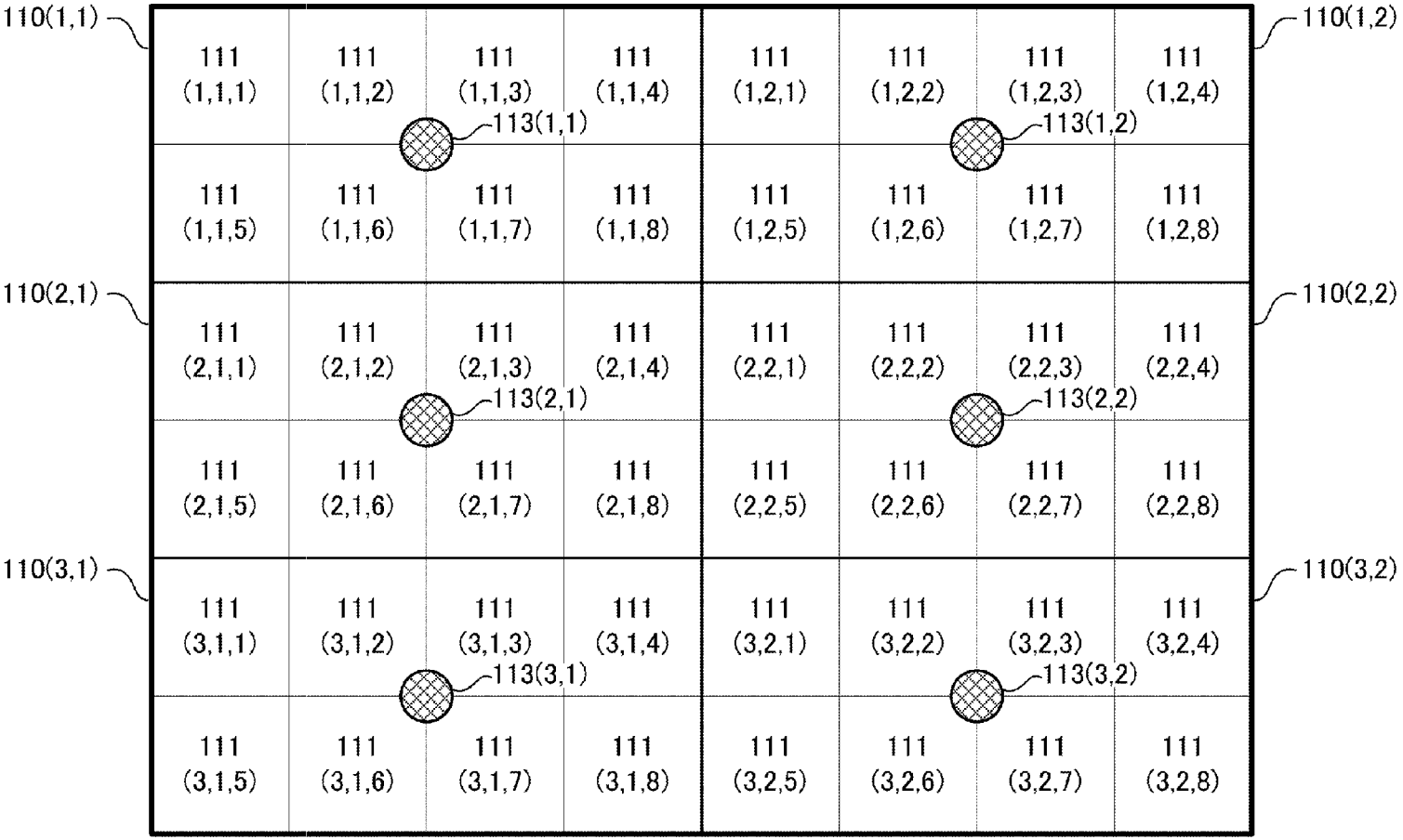
FIG. 2 is a construction view of an LED backlight apparatus according to a first embodiment of the present invention.

FIG. 2 is a schematic view showing an example of the arrangement of the LED boards 110, the light emission blocks 111 and the optical sensors 113 in the LED backlight apparatus 101, when seen from a front direction (i.e., from a side of the color liquid crystal panel 105). An LED board 110 (1, 1) is arranged at an upper left end of the LED backlight apparatus 101, and an LED board 110 (1, 2) is arranged in a lateral or horizontal right direction of the LED board 110 (1, 1), and an LED board 110 (2, 1) and an LED board 110 (3, 1) are arranged in order in a longitudinal Or vertical downward direction. Similarly, an LED board 110 (2, 2) and an LED board 110 (3, 2) are arranged in order in a longitudinal or vertical downward direction of the LED board 110 (1, 2) which is at an upper right side of the LED backlight apparatus 101. As mentioned above, the LED backlight apparatus 101 is constructed of a total of six LED boards 110, which are arranged in a 2×3 matrix form (i.e., 2 columns (in the horizontal direction) by 3 rows (in the vertical direction)).

The LED board 110 (1, 1) is composed of a light emission block 111 (1, 1, 1), a light emission block 111 (1, 1, 2), a light emission block 111 (1, 1, 3), a light emission block 111 (1, 1, 4), a light emission block 111 (1, 1, 5), a light emission block 111 (1, 1, 6), a light emission block 111 (1, 1, 7), a light emission block 111 (1, 1, 8), and an optical sensor 113 (1, 1). Each of the other LED boards 110 (1, 2), 110 (2, 1), 110 (2, 2), 110 (3, 1), 110 (3, 2) has the same construction as that of the LED board 110 (1, 1) (refer to FIG. 2).

Figure 3:
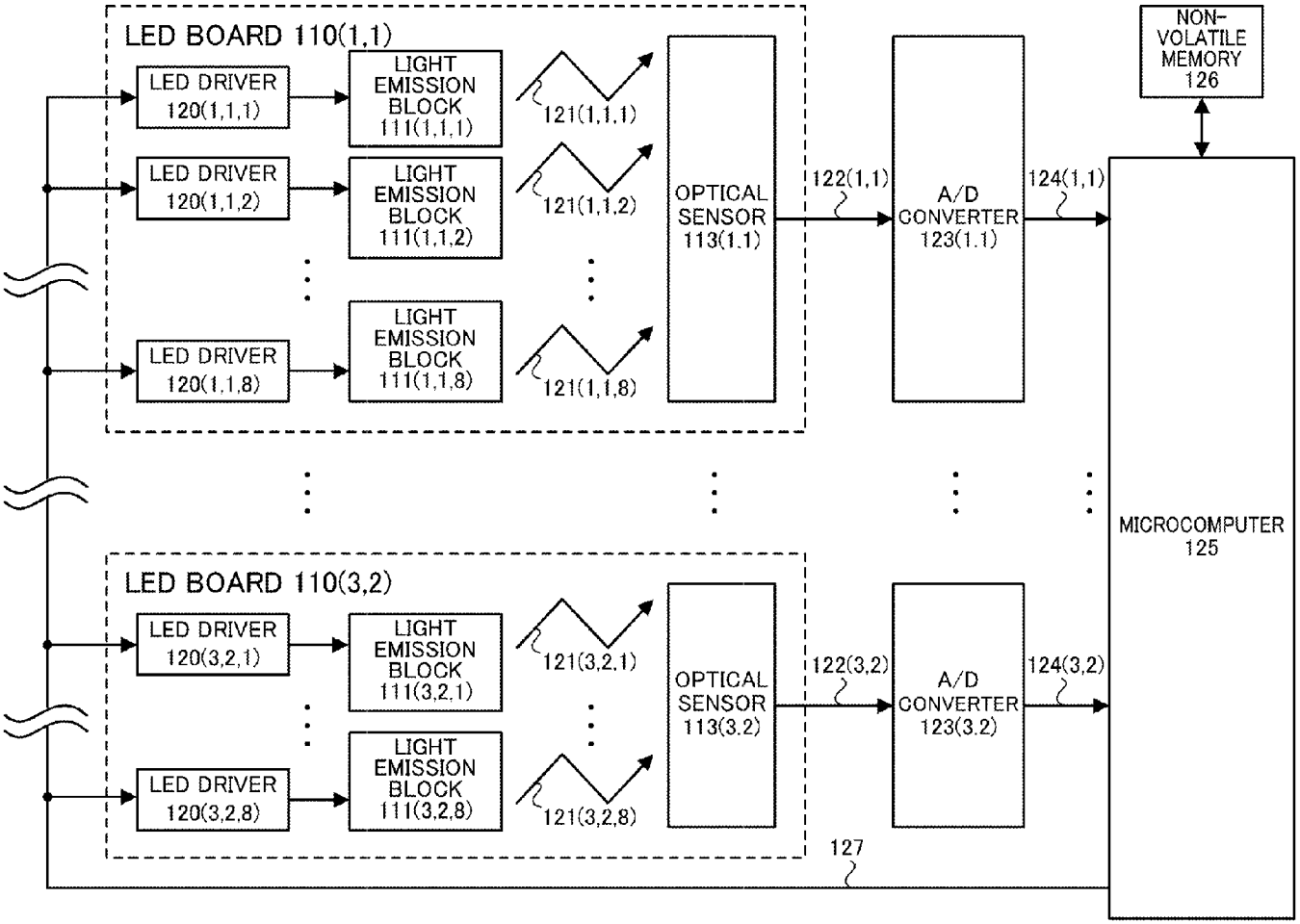
FIG. 3 is a block diagram showing an example of a connection arrangement in the LED backlight apparatus.

FIG. 3 is a block diagram showing an example of a connection arrangement in the LED backlight apparatus 101. The internal configurations of a total of six sheets of LED boards 110 are equivalent to one another, and so the LED board 110 (1, 1) will be explained, as an example. The LED board 110 (1, 1) is provided with the light emission block 111 (1, 1, 1) through the light emission block 111 (1, 1, 8). The brightnesses (intensities) of the individual light emission blocks 111 (1, 1, 1) through 111 (1, 1, 8) are controlled by means of PWM control from an LED driver 120 (1, 1, 1) through an LED driver 120 (1, 1, 8), respectively. Here, note that a method of brightness control may be based on an amount of electric current or voltage. Most of a light emission 121 (1, 1, 1) through a light emission 121 (1, 1, 8) from the individual light emission blocks 111 (1, 1, 1) through 111 (1, 1, 8), respectively, are incident to the color liquid crystal panel 105 (not shown in FIG. 3). However, a part of these light emissions is incident to the optical sensor 113 (1, 1) after being reflected by the diffuser 102 (not shown in FIG. 3) or by the reflection type polarization film 104 (not shown in FIG. 3).

In order to reduce brightness unevenness generated due to variations in the temperature and the extent of aged deterioration among the light emission blocks 111, the brightnesses of the light emission blocks 111 are detected by the use of the optical sensors 113 at periodical or specific timing.

The brightness detection by the optical sensor 113 (1, 1) is carried out in a state where any one of the light emission block 111 (1, 1, 1) through the light emission block 111 (1, 1, 8) is lit or turned on. According to this, the brightness detection is made possible in a state where a light emission 121 from any one of the light emission 121 (1, 1, 1) through the light emission 121 (1, 1, 8) has entered the optical sensor 113 (1, 1). In this connection, however, leakage light (not shown in FIG. 3) from light emission blocks 111 of other LED boards 110 which have been turned on at the same time also enters the optical sensor 113 (1, 1). In this embodiment, in a state where a plurality of light emission blocks 111 belonging to different LED boards 110, respectively, are caused to turn on at the same time, brightnesses are detected by the use of a plurality of optical sensors 113 which similarly belong to the different LED boards 110, respectively. This shortens the time required for detection and correction of the LED backlight apparatus 101 as a whole.

An analog value 122 (1, 1) of an optical sensor detection brightness outputted from the optical sensor 113 (1, 1) is subjected to an analog to digital conversion by an A/D converter 123 (1, 1), and a digital value 124 (1, 1) of the optical sensor detection brightness thus obtained is inputted to a microcomputer 125.

Similarly, analog values 122 of optical sensor detection brightnesses from the other LED boards 110 are also subjected to analog to digital conversion by means of corresponding A/D converters 123, respectively, and digital values 124 of the optical sensor detection brightnesses of a total of six channels are inputted to the microcomputer 125.

A brightness target value of each light emission block 111, which has been decided at the time of manufacturing test of the color image display apparatus, etc., is held in a non-volatile memory 126 which is connected to the microcomputer 125. By causing each light emission block 111 to emit light at a brightness equivalent to its target brightness value, the brightness unevenness of the LED backlight apparatus as a whole is suppressed.

In the microcomputer 125, the brightness of each light emission block 111 is obtained after subtracting a detection brightness due to the influence of leakage light from a digital value 124 of a corresponding optical sensor detection brightness.

In the microcomputer 125, a comparison is made between the brightness of each light emission block 111 and a target brightness value of the light emission block 111 held in the non-volatile memory 126, and a corresponding LED driver 120 is controlled so that the brightness of each light emission block 111 becomes equivalent to its target brightness value. The control of each LED driver 120 is carried out through a corresponding LED driver control signal 127 from the microcomputer 125.

In this embodiment, the microcomputer 125 causes a total of two light emission blocks 111 selected one by one from different LED boards 110 to emit light in one set at the same time, and obtains the values of brightnesses detected at that time by optical sensors 113 which are provided on LED boards 110 to which the two light emission blocks 111 belong, respectively. Although each optical sensor 113 has, for its brightness detection objects, those light emission blocks 111 which belong to an LED board 110 on which the optical sensor 113 is provided, the light emitted by the other light emission block 111 which carries out simultaneous light emission with the one light emission block 111 enters other optical sensors 113 as a leakage light. An error is contained in the detection value of the brightness of a light emission block 111 detected by each optical sensor 113, resulting from this leakage light. The microcomputer 125 corrects the error contained in the detection value of the brightness detected by each optical sensor 113, and carries out calibration to correct an amount of light emission (PWM control value, etc.) of each light emission block 111 based on the result of a comparison between the detection value thus corrected and a corresponding target value stored in the non-volatile memory 126. As the number of light emission blocks increases, the time required for calibration becomes longer. However, by causing a plurality of light emission blocks to emit light at the same time and carrying out the calibration of the plurality of light emission blocks at the same time in this manner, it is possible to shorten the time required for the calibration of the entire backlight apparatus. Although in this embodiment, an example is described in which two light emission blocks are caused to emit light at the same time to carry out the calibration thereof, the number of light emission blocks which are caused to emit light at the same time is not limited to this. In addition, data with respect to the influence and error which are exerted on the detected values of the optical sensors 113 by the leakage lights from the light emission blocks 111 carrying out simultaneous light emissions have been investigated and stored in the non-volatile memory 126 in advance. The microcomputer 125 can correct the error by referring to this data. Alternatively, the construction may also be such that the relation between the positional relation of the light emission blocks 111 carrying out simultaneous light emissions and each optical sensor 113, and the influence exerted on the detected values of the optical sensors 113 by the leakage lights is obtained by arithmetic operations.

FIG. 4 is a correspondence table showing an example of the order of detection of the individual light emission blocks 111 and grouping or combination of light emission blocks 111 which are caused to turn on at the same time at each turn of detection. Brightness detection of the individual light emission blocks 111 is carried out according to the order of detection 200 for all the sets or pairs in a sequential manner. The order of detection 200 is decided from the 1st to the 24th, and at each turn of the order of detection 200, two light emission blocks 111 are caused to emit light at the same time. That is, they are a light emission block A201 selected from a light emission block group A which is a first light emission block group, and a light emission block B203 selected from a light emission block group B which is a second light emission block group. In addition, each brightness detection is carried out by the use of an optical sensor 202 for detection of the light emission blocks A which is a first detection unit corresponding to the first light emission block group, and an optical sensor 204 for detection of the light emission blocks B which is a second detection unit corresponding to the second light emission block group.

Here, when seen from a front direction (from the side of the color liquid crystal panel 105), a left half of the LED backlight apparatus 101 is assigned as light emission blocks A201, and a right half thereof is assigned as light emission blocks B203.

For example, in the first of the order of detection 200, a total of two light emission blocks 111, i.e., the light emission block 111 (1, 1, 1) as a light emission block A201 and the light emission block 111 (1, 2, 4) as a light emission block B203, are caused to turn on at the same time. In addition, brightness detection is carried out by using the optical sensor 113 (1, 1) as an optical sensor 202 for detection of the light emission blocks A, and the optical sensor 113 (1, 2) as an optical sensor 204 for detection of the light emission blocks B, respectively.

The set or combination of a light emission block A201 and a light emission block B203, which are caused to turn on at the same time at each turn of the order of detection 200, is decided in such a manner that a minimum value of a detection value ratio $R_V$ of each light emission block 111 in the entire backlight apparatus 101 becomes more larger. A decision procedure for such a combination will be described later in detail. In addition, details will also be described later for the definition of the detection value ratio $R_V$ and the reason for using such a combination in which the minimum value of the detection value ratio $R_V$ of each light emission block 111 in the entire backlight apparatus becomes larger. The information on the pairs of the light emission blocks to be caused to emit light at the same time and the order of detection as shown in FIG. 4 has been set in advance and stored in the non-volatile memory 126. By referring to table data of FIG. 4 at the time of execution of calibration, the microcomputer 125 obtains the information on a combination of light emission blocks to be caused to emit light at the same time and an order of detection thereof. Then, the LED drivers 120 are controlled by the microcomputer 125 so that two light emission blocks in combination thus obtained are caused to emit light at the same time according to the order of detection thus obtained. Thereafter, the microcomputer 125 carries out calibration of the backlight apparatus by obtaining the detected value of an optical sensor 113 at that time, and making a comparison of the detected value with a target value thereof.

FIG. 5 is a correspondence table showing an example of a measured value of the detection value ratio $R_V$ in each light emission block 111 at each turn in the order of detection 200 shown in the correspondence table of FIG. 4. With respect to each of a light emission block A201 and a light emission block B203 at each turn in the order of detection 200, a detection value ratio $R_V$ 205 for the light emission block A and a detection value ratio $R_V$206 for the light emission block B are obtained by actual measurements. It can be seen from the correspondence table of FIG. 5 that the minimum value of the detection value ratio $R_V$ of each light emission block 111 in the entire backlight apparatus in this embodiment is 2.1.

In the following, the definition of the detection value ratio $R_V$ will be described.

Figure 6:
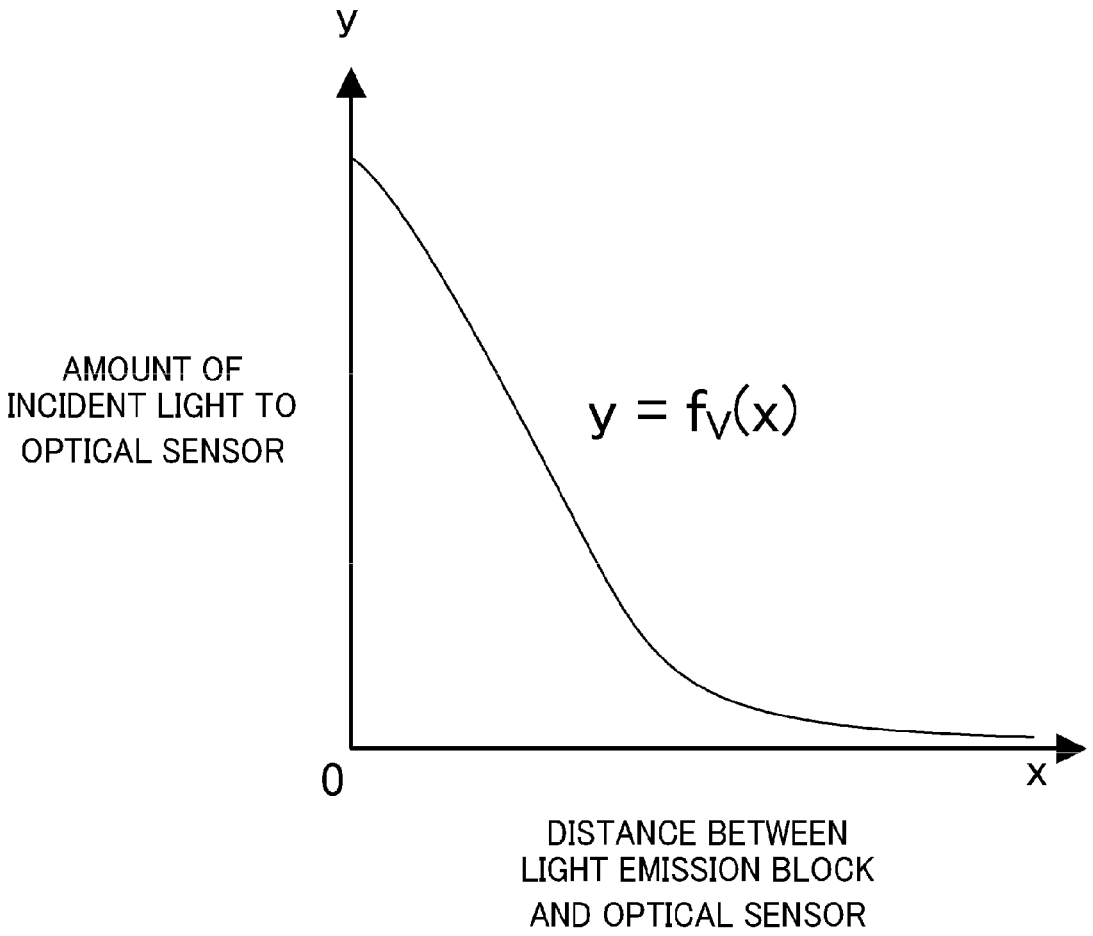
FIG. 6 shows a relation between a distance between each light emission block and an optical sensor, and an amount of incident light to the optical sensor.

FIG. 6 is a graph in which an amount of incident light (y) to an optical sensor 113 at the time of causing one certain light emission block 111 to turn on independently is plotted with respect to a distance (x) between the light emission block and the optical sensor 113. Light emitted from the light emission block 111 enters the optical sensor 113, after being reflected by the diffuser 102 and the reflection type polarization film 104, which are arranged directly above the optical sensor 113. For that reason, a curve ($y=f_v(x)$) is drawn in which the amount of incident light (y) to the optical sensor becomes larger in inverse proportion to the decreasing distance (x) between the light emission block and the optical sensor. In other words, the nearer the light emission block 111 and the optical sensor 113, the more becomes the amount of incident light to the optical sensor 113.

The detection value ratio $R_V$ is a ratio of a detected value of an amount of light due to the emission of light 121 from one light emission block 111 to be detected, and a detected value of an amount of light due to leakage light from the other light emission block 111 which is turned on at the same time, in the detected value of the amount of light received by one certain optical sensor 113 (the following expression 1).

$$Rv = \frac{\text{detection value due to an emission of light from a light emission block to be detected}}{\text{detection value due to leakage light from another light emission block being turned on at same time}} \quad \text{(Expression 1)}$$

The numerator and the denominator of the expression 1 are both in inverse proportion to the distance between the light emissions block 111 and the optical sensor 113, as shown in FIG. 6. Accordingly, it can be said that in one certain optical sensor 113, the detection value ratio $R_V$ is also in inverse proportion to the distance between the one light emission block 111 to be detected and the optical sensor 113 divided by the distance between the other light emission block 111 being turned on at the same time and the optical sensor 113 (the following expression 2).

$$\frac{1}{Rv} \propto \frac{\text{distance between light emission block to be detected and optical sensor}}{\text{distance between another light emission block being turned on at the same time and optical sensor}} \quad \text{(Expression 2)}$$

From the above, it can be seen that in order to make the detection value ratio $R_V$ larger, the distance between the one light emission block 111 to be detected and the optical sensor 113 should be made smaller, and the distance between the other light emission block 111 being turned on at the same time and the optical sensor 113 should be made larger.

Next, reference will be made to the reason for using such a combination in which the minimum value of the detection value ratio $R_V$ of each light emission block 111 in the entire backlight apparatus becomes larger.

FIG. 7A is a schematic diagram showing an example of components of an optical sensor detection brightness in cases where the detection value ratio $R_V$ is large. An optical sensor detection brightness 302*a* has its components including, as a major proportion, a detection brightness 300*a* due to the emission of light from the light emission block 111 which becomes an object to be detected, and as a small proportion, a detection brightness 301*a* due to leakage light from the other light emission block 111 being turned on at the same time.

FIG. 7B is a schematic diagram showing an example of components of an optical sensor detection brightness in cases where the detection value ratio $R_V$ is small. An optical sensor detection brightness 302*b* has its components divided into two nearly equal proportions, i.e., a detection brightness 300*b* due to the emission of light from the light emission block 111 which becomes an object to be detected, and a detection brightness 301*b* due to leakage light from the other light emission block 111 being turned on at the same time.

The optical sensor detection brightness 302*a* in FIG. 7A and the optical sensor detection brightness 302*b* in FIG. 7B are gain controlled in such a manner that their digital values obtained after these detection brightnesses are subjected to analog to digital conversion by means of the A/D converters 123 become equivalent to each other. Accordingly, in cases where the detection value ratio $R_V$ is small, as shown in FIG. 7B, the digital value of the detected brightness 300*b* after analog to digital conversion thereof due to the emission of light from the light emission block 111 to be detected will also be small. In other words, in cases where the detection value ratio $R_V$ is small, a detection error due to a quantum error or the like becomes large.

FIG. 7C is a schematic diagram showing the relation between detection errors of the individual light emission blocks 111 of the entire backlight apparatus, and a maximum value of the brightness unevenness of the backlight apparatus. As explained before, a detection error 400 of each light emission block is decided according to the detection value ratio $R_V$ of the light emission block 111. A maximum value 401 of the brightness unevenness of the backlight apparatus is decided by a maximum value of the detection error 400 of each light emission block in the entire backlight apparatus. Accordingly, it can be seen that the brightness unevenness maximum value 401 of the backlight apparatus can be suppressed by using a combination in which a minimum value of the detection value ratio $R_V$ in the entire backlight apparatus becomes larger.

Next, reference will be made to a procedure for deciding such a combination in which the minimum value of the detection value ratio $R_V$ of each light emission block 111 in the entire backlight apparatus becomes larger.

Figure 8:
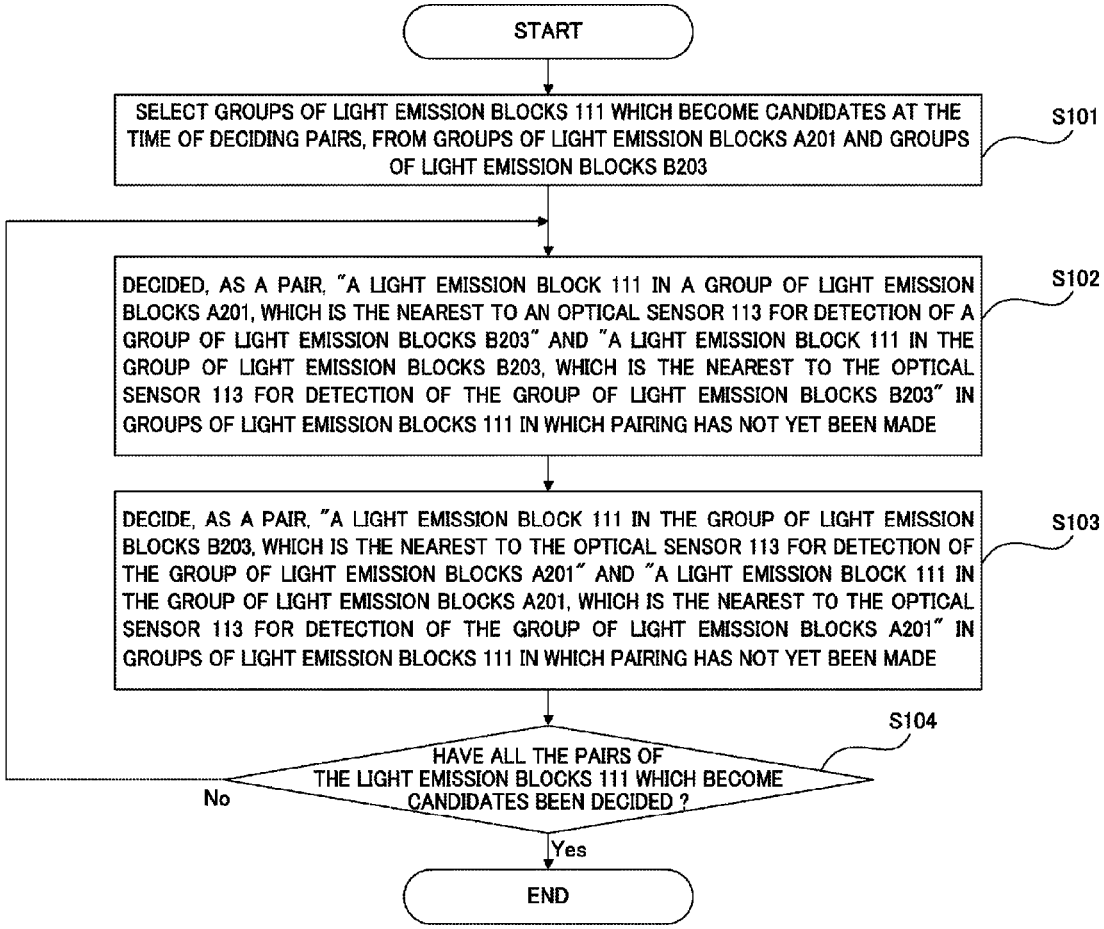
FIG. 8 shows an example of a flow chart showing a procedure to decide pairs of light emission blocks according to a first embodiment of the present invention.

FIG. 8 is an example of a flow chart showing a procedure to decide combinations (pairs) of light emission blocks. The processing shown in this flow chart is carried out by a computer which is different or separate from the backlight apparatus, for example at the time of production of the backlight apparatus, and table data, as shown in FIG. 4, obtained as a result of the execution is written into the non-volatile memory 126 of the backlight apparatus. As a result of this, the microcomputer 125 can carry out the calibration of the backlight apparatus in the order of detection and the combination of the light emission blocks 111 according to this table data. Alternatively, it may be constructed such that a program to cause the microcomputer 125 to carry out the processing represented by this flow chart has been stored in the non-volatile memory 126, and table data as shown in FIG. 4 is created by the microcomputer 125 by causing the microcomputer 125 to execute the program. Alternatively, the construction may be such that a program represented by this flow chart is provided to the backlight apparatus or the liquid crystal display device through a cable or radio communication means or a recording medium such as a memory card, a CD-ROM, or the like, whereby the program thus provided is executed by the microcomputer 125. Alternatively, a computer, on which a program represented by this flow chart is installed and which is connected to the liquid crystal display device through a cable or radio communication means, may obtain configuration information on the light emission blocks 111 of the backlight apparatus, etc., through the communication means. Then, the computer may create table data as shown in FIG. 4 by carrying out the processing of this flow chart based on the configuration information thus obtained. In this case, the computer may have a function to control the backlight apparatus of the liquid crystal display device from the outside thereof based on the table data thus created, or may transmit the created table data to the liquid crystal display device so that the microcomputer 125 can refer to the table data. In addition, a backlight apparatus, which carries out calibration by the use of the table data shown in FIG. 4, and its calibration method, are included in the scope of the present invention, without regard to a main body or component to execute the decision procedure represented by this flow chart. First, in step S101, groups of light emission blocks 111 which become candidates at the time of deciding pairs are selected from groups of light emission blocks A201 and groups of light emission blocks B203.

Figure 9:
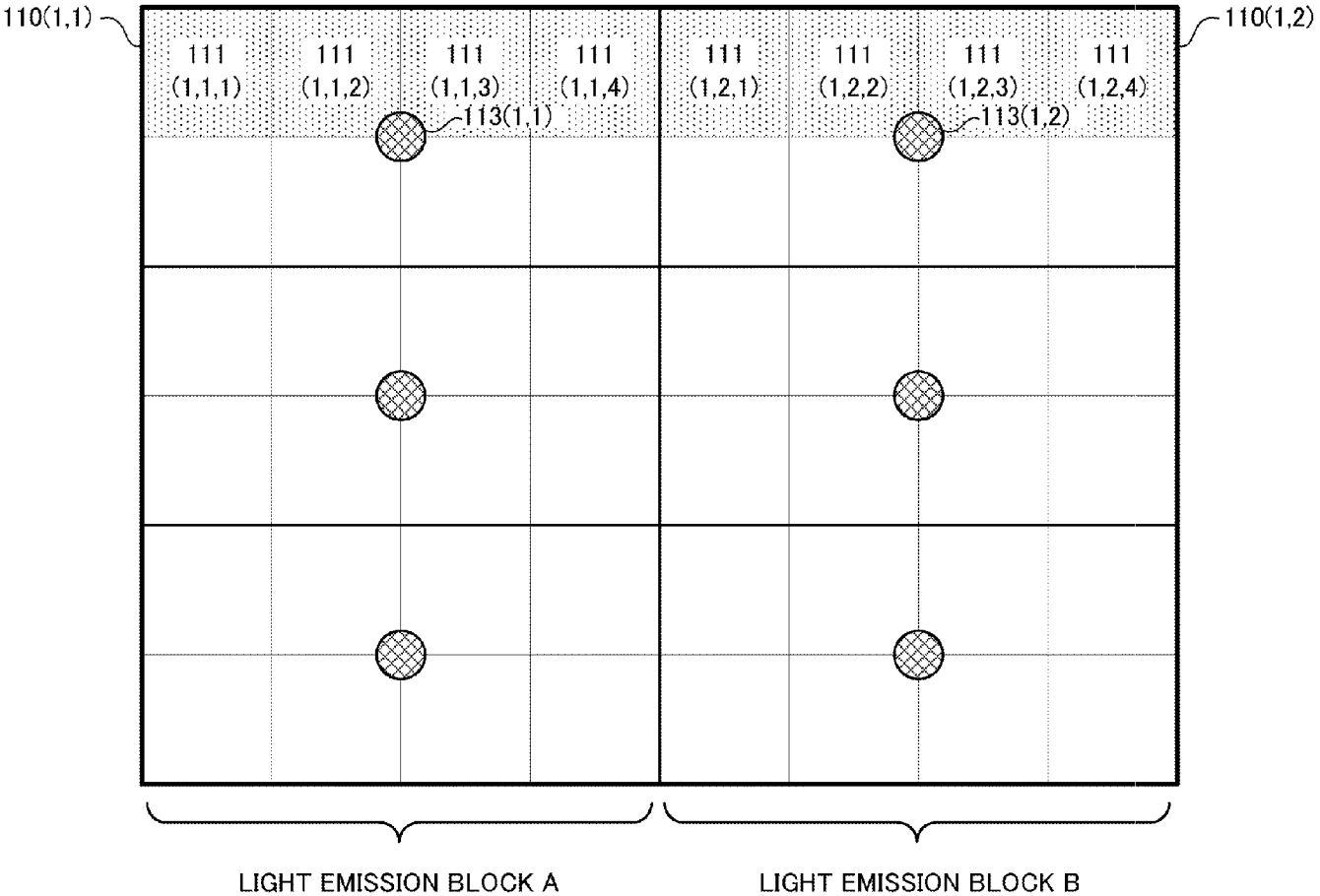
FIG. 9 is a view showing an example of light emission block groups which become candidates for deciding pairs in the first embodiment of the present invention.

FIG. 9 is a schematic view showing an example of groups of light emission blocks 111 which have been selected in step S101. In this embodiment, when looking at the LED backlight apparatus 101 from its front direction (from the side of the color liquid crystal panel 105), groups of light emission blocks lying in the left half thereof are assigned as the groups of light emission blocks A201, and groups of light emission blocks lying in the right half thereof are assigned as the groups of light emission blocks B203. From among these, light emission blocks 111 at the first row from the upper end are selected as groups of light emission blocks 111 which become candidates at the time of deciding pairs. Specifically, four of the light emission block 111 (1, 1, 1) through the light emission block 111 (1, 1, 4) are selected from the groups of light emission blocks A201, and four of the light emission block 111 (1, 2, 1) through the light emission block 111 (1, 2, 4) are selected from the groups of light emission blocks B203. Here, the reason for having selected the groups of light emission blocks 111 at one row as candidates will be explained below. That is, it may be constructed such that in lighting control by means of the PWM of the backlight apparatus, light emission blocks 111 at the same row are controlled to be turned on in synchronization in timing with one another. This is because in this case, it is easy to carry out control to cause a plurality of light emission blocks 111 to be turned on at the same time, in the case of brightness detection. However, how to select groups of light emission blocks which become candidates at the time of deciding pairs is not limited to the above-mentioned example. As will be described later, it is also permitted to make such a selection that four light emission blocks 111 to be selected from the groups of light emission blocks A201, and four light emission blocks 111 to be selected from the groups of light emission blocks B203 belong to different rows, respectively.

Then, in step S102 in FIG. 8, in those groups of light emission blocks 111 in which pairing has not yet been made, among the groups of light emission blocks 111 selected in step S101, (1) a light emission block 111 in a group of light emission blocks A201, which is the nearest to an optical sensor 113 for detection of a group of light emission blocks B203, and (2) a light emission block 111 in the group of light emission blocks B203, which is the nearest to the optical sensor 113 for detection of the group of light emission blocks B203, are decided as a pair.

Figure 10A:
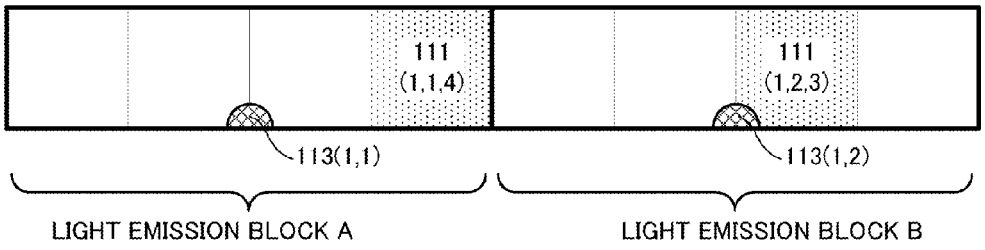
FIGS. 10A through 10E are views showing examples of pairs of light emission blocks to be decided, respectively, in the first embodiment of the present invention.

FIG. 10A is a schematic view showing an example of light emission blocks 111 which have been decided as a pair in step S102. The light emission block 111 (1, 1, 4) is selected as "a light emission block 111 in a group of light emission blocks A201, which is the nearest to an optical sensor 113 for detection of a group of light emission blocks B203". In addition, the light emission block 111 (1, 2, 3) is selected as "a light emission block 111 in the group of light emission blocks B203, which is the nearest to the optical sensor 113 for detection of the group of light emission blocks B203". As the latter (i.e., the light emission block 111 in the group of light emission blocks B203), the light emission block 111 (1, 2, 2) may instead be selected.

Figure 10B:
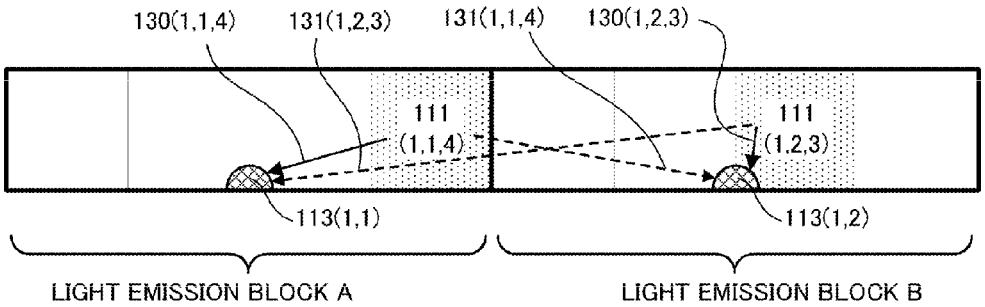

FIG. 10B is a schematic view showing a state of light emission at the time when the light emission blocks 111 (1, 1, 4) and 111 (1, 2, 3) decided as a pair in step S102 have been turned on at the same time. The light emission block 111 (1, 1, 4) and the optical sensor 113 (1, 1) for detecting this are separated from each other by 2 blocks, so the amount of incident light to the optical sensor 113 (1, 1) by the emission of light 130 (1, 1, 4) from the light emission block 111 (1, 1, 4) is not so large. However, the light emission block 111 (1, 2, 3) being turned on at the same time and the optical sensor 113 (1, 1) are separated from each other by 5 blocks, so the amount of incident light to the optical sensor 113 (1, 1) by leakage light 131 (1, 2, 3) from the light emission block 111 (1, 2, 3) is small to a sufficient extent. Accordingly, a sufficiently large value is obtained for the detection value ratio $R_V$ of the light emission block 111 (1, 1, 4). As previously shown in FIG. 5, the measured value of the detection value ratio $R_V$ of the light emission block 111 (1, 1, 4) is 6.6. Here, for example, if the light emission block 111 (1, 1, 4) and the light emission block 111 (1, 2, 1) are decided as a pair, without following the combination decision procedure of this embodiment, the detection value ratio $R_V$ of the light emission block 111 (1, 1, 4) will become remarkably small.

On the other hand, the light emission block 111 (1, 1, 4) and the optical sensor 113 (1, 2) are separated from each other by only 3 blocks, so the amount of incident light to the optical sensor 113 (1, 2) by leakage light 131 (1, 1, 4) from the light emission block 111 (1, 1, 4) is relatively large. However, the light emission block 111 (1, 2, 3) and the optical sensor 113 (1, 2) for detecting this are also separated from each other by only 1 block, so the amount of incident light to the optical sensor 113 (1, 2) by the emission of light 130 (1, 2, 3) from the light emission block 111 (1, 2, 3) is large to a sufficient extent. Accordingly, a not so small value is obtained for the detection value ratio $R_V$ of the light emission block 111 (1, 2, 3). As previously shown in FIG. 5, the measured value of the detection value ratio $R_V$ of the light emission block 111 (1, 2, 3) is 2.1. Here, for example, if the light emission block 111 (1, 1, 4) and the light emission block 111 (1, 2, 4) are decided as a pair, without following the combination decision procedure of this embodiment, the detection value ratio $R_V$ of the light emission block 111 (1, 1, 4) will become remarkably small.

Returning to FIG. 8, in step S103, in those groups of light emission blocks 111 in which pairing has not yet been made, among the groups of light emission blocks 111 selected in step S101, (1) a light emission block 111 in the group of light emission blocks B203, which is the nearest to the optical sensor 113 for detection of the group of light emission blocks A201, and (2) a light emission block 111 in the group of light emission blocks A201, which is the nearest to the optical sensor 113 for detection of the group of light emission blocks A201, are decided as a pair.

Figure 10C:
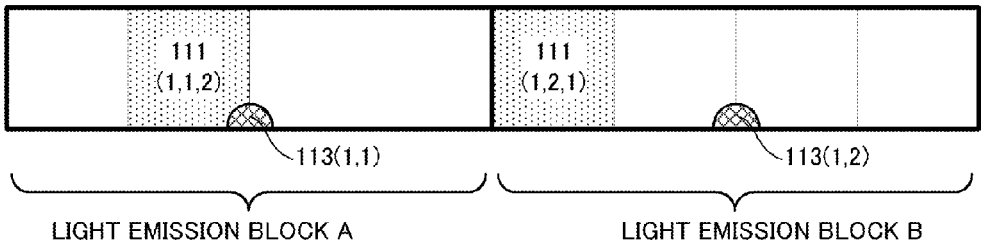

FIG. 10C is a schematic view showing an example of light emission blocks 111 which have been decided as a pair in step S103. The light emission block 111 (1, 2, 1) is selected as "a light emission block 111 in the group of light emission blocks B203, which is the nearest to the optical sensor 113 for detection of the group of light emission blocks A201". In addition, the light emission block 111 (1, 1, 2) is selected as "a light emission block 111 in the group of light emission blocks A201, which is the nearest to the optical sensor 113 for detection of the group of light emission blocks A201". As the latter (i.e., the light emission block 111 in the group of light emission blocks A201), the light emission block 111 (1, 1, 3) may instead be selected.

Thereafter, in step S104 of FIG. 8, it is determined whether all the pairs of the light emission blocks 111 which become candidates have been decided. In cases where all the pairs of the light emission blocks 111 which become candidates have been decided, the procedure of this flow chart is all completed, but in cases where they have not yet been decided, a return is again made to step S102.

Figure 10D:
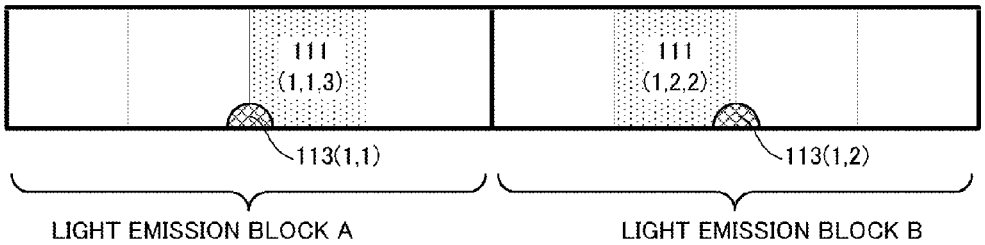

FIG. 10D is a schematic view showing an example of light emission blocks 111 which have been decided as a pair in step S102 of a second round. The light emission block 111 (1, 1, 3) is selected as "a light emission block 111 in the group of light emission blocks A201, which is the nearest to the optical sensor 113 for detection of the group of light emission blocks B203". In addition, the light emission block 111 (1, 2, 2) is selected as "a light emission block 111 in the group of light emission blocks B203, which is the nearest to the optical sensor 113 for detection of the group of light emission blocks B203".

Figure 10E:
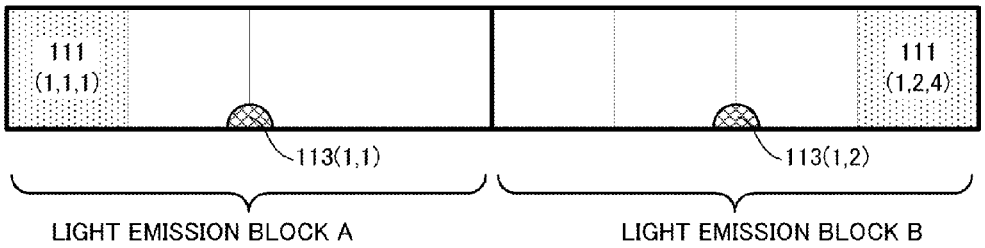

FIG. 10E is a schematic view showing an example of light emission blocks 111 which have been decided as a pair in step S103 of the second round. Here, there is only one light emission block 111 which has not yet been decided as a pair, in each of the group of light emission blocks A201 and the group of light emission blocks B203, and hence, there is no combination which makes a pair, other than a combination of the light emission block 111 (1, 1, 1) and the light emission block 111 (1, 2, 4).

From the above, it means that the 1st to the 4th of the order of detection 200 in the correspondence table of FIG. 4 have been decided by the combination decision procedure shown in FIG. 8. With reference to the 5th to the 24th of the order of detection 200, it is possible to decide them by selecting, in step S101 of FIG. 8, light emission blocks 111 from the second row onward from the upper end as groups of light emission blocks 111 which become candidates at the time of deciding pairs.

Here, reference has been made to an example in which in step S101 of FIG. 8, groups of light emission blocks 111 at one row are selected as groups of light emission blocks 111 which become candidates at the time of deciding pairs. However, it is also possible to decide pairs from among groups of light emission blocks 111 over a plurality of rows according to the above-mentioned pair decision method.

Figure 11:
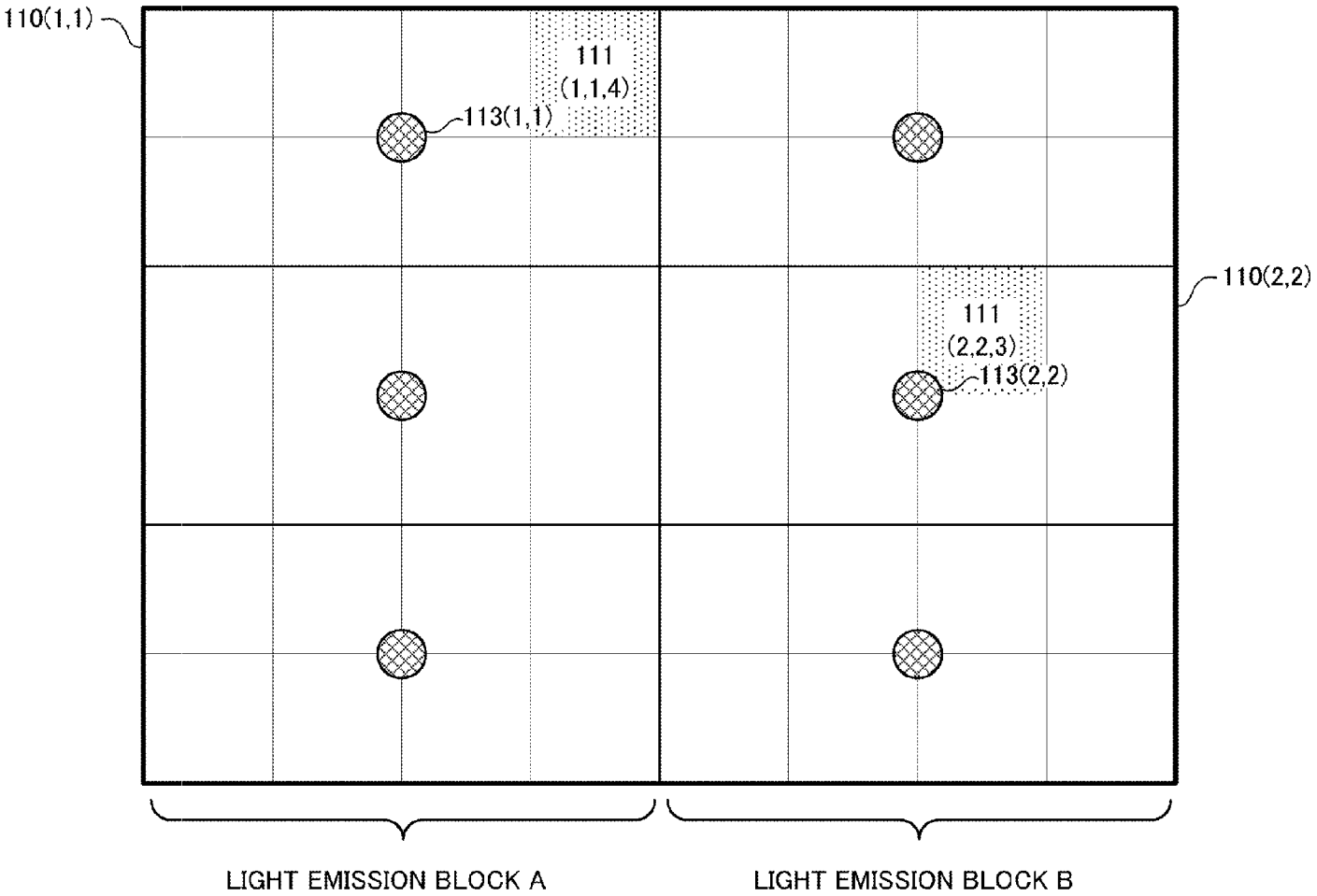
FIG. 11 is a view showing an example of pairs of light emission blocks decided over a plurality of TOWS.

FIG. 11 is a schematic view showing an example of a pair decided among from groups of light emission blocks 111 over a plurality of rows. In the example of FIG. 11, the light emission block 111 (1, 1, 1) through the light emission block 111 (1, 1, 4) are selected as a group of light emission blocks A201, and the light emission block 111 (2, 2, 1) through the light emission block 111 (2, 2, 4) are selected as a group of light emission blocks B203. The example of FIG. 11 is an example of a combination of light emission blocks 111 which are decided as a pair in step S102 of a first round, in cases where the pair is decided according to the flow chart of FIG. 8. The light emission block 111 (1, 1, 4) is selected as a light emission block A201, and the light emission block 111 (2, 2, 3) is selected as a light emission block B203. Thus, in cases where four light emission blocks at the 1st row of the LED board 110 (1, 1) and four light emission blocks at the 1st row of the LED board 110 (2, 2) are selected as candidates for pair decision, too, a pair can be decided according to the flow chart of FIG. 8. Here, note that the pair shown in FIG. 11 is resultantly equal to one in the 4th of the order of detection 200 in the correspondence table of FIG. 4 in which the light emission block 111 (1, 2, 3) paired with the light emission block 111 (1, 1, 4) is replaced by the light emission block 111 (2, 2, 3) which is away therefrom by two rows. Similarly, light emission blocks 111 in the light emission blocks B203 in the correspondence table of FIG. 4 are replaced by light emission blocks 111 away therefrom by two rows, respectively. According to this, it becomes possible to obtain the pairs which are decided in cases where four light emission blocks at the 1st row of the LED board 110 (1, 1) and four light emission blocks at the 1st row of the LED board 110 (2, 2) are selected as candidates for pair decision.

Figure 12:
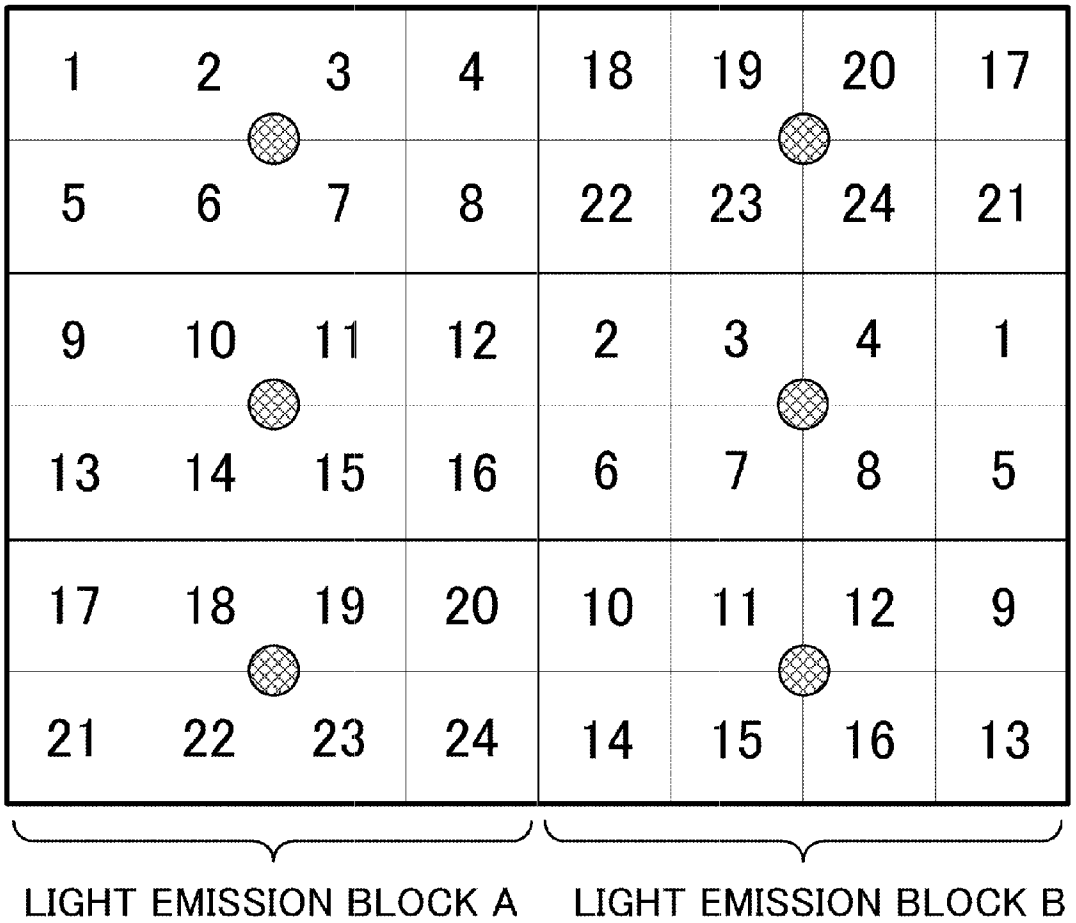
FIG. 12 is a view showing another example of pairs of light emission blocks decided over a plurality of rows.

FIG. 12 is a schematic view showing an example of an arrangement of pairs decided from among groups of light emission blocks 111 over a plurality of rows. The numbers in this figure are values which correspond to the order of detection 200, and light emission blocks 111 of the same values form pairs. The pair of the light emission block 111 (1, 1, 4) and the light emission block 111 (2, 2, 3) exemplified in FIG. 11 is an example in which the group of light emission blocks A201 and the group of light emission blocks B203 are away from each other by two rows. On the other hand, for example, in pairs of the 17th—the 20th of the order of detection shown in FIG. 12, a group of light emission blocks A201 and a group of light emission blocks B203 are away from each other by four rows. In this manner, even in cases where groups of light emission blocks 111 which become candidates for deciding pairs, i.e., a group of light emission blocks A201 and a group of light emission blocks B203, are away from each other by a plurality of rows, pairs can be decided according to the flow chart of FIG. 8.

As described above, by applying this embodiment, the brightnesses of a plurality of light emission blocks 111 are detected at the same time by the use of a plurality of optical sensors 113 in a state where the plurality of light emission blocks 111 are caused to turn on at the same time. Then, at that time, detection errors will occur because lights emitted by light emission blocks 111 other than a light emission block 111 which is to be detected by a corresponding optical sensor 113 enter each optical sensor 113 as leakage light. However, it is possible to carry out calibration by causing a plurality of light emission blocks 111 to emit light at the same time in a combination thereof which can make such detection errors as small as possible. Thus, when calibration is carried out based on the result of detection in which the brightnesses of a plurality of light emission blocks are detected at the same time by a plurality of optical sensors corresponding to the individual light emission blocks, respectively, by causing the plurality of light emission blocks to emit light at the same time, in a combination thereof decided by the method explained in this embodiment, it is possible to carry out the calibration with a high degree of accuracy. As a result, according to this embodiment, it becomes possible to suppress brightness unevenness in an effective manner.

Incidentally, another method can also be considered in which combinations are all decided from the detection value ratio $R_V$ according to actual measurements, without using the combination decision procedure shown in FIG. 8 of this embodiment. In this case, however, it is necessary to make actual measurements covering examples of all combinations or sets, and hence such a method is not efficient, and the predominance of using the combination decision procedure of this embodiment is high.

Second Embodiment

In this second embodiment, reference will be made to the fact that the present invention can be applied, even in cases where the number of optical sensors with respect to the number of the light emission blocks is different from that in the first embodiment. Here, note that in the individual figures and procedures, the same parts or elements as those of the above-mentioned first embodiment are denoted by the same reference numerals and characters, and the explanation thereof is omitted. Hereinafter, a backlight apparatus according to the second embodiment of the present invention will be described.

Figure 13:
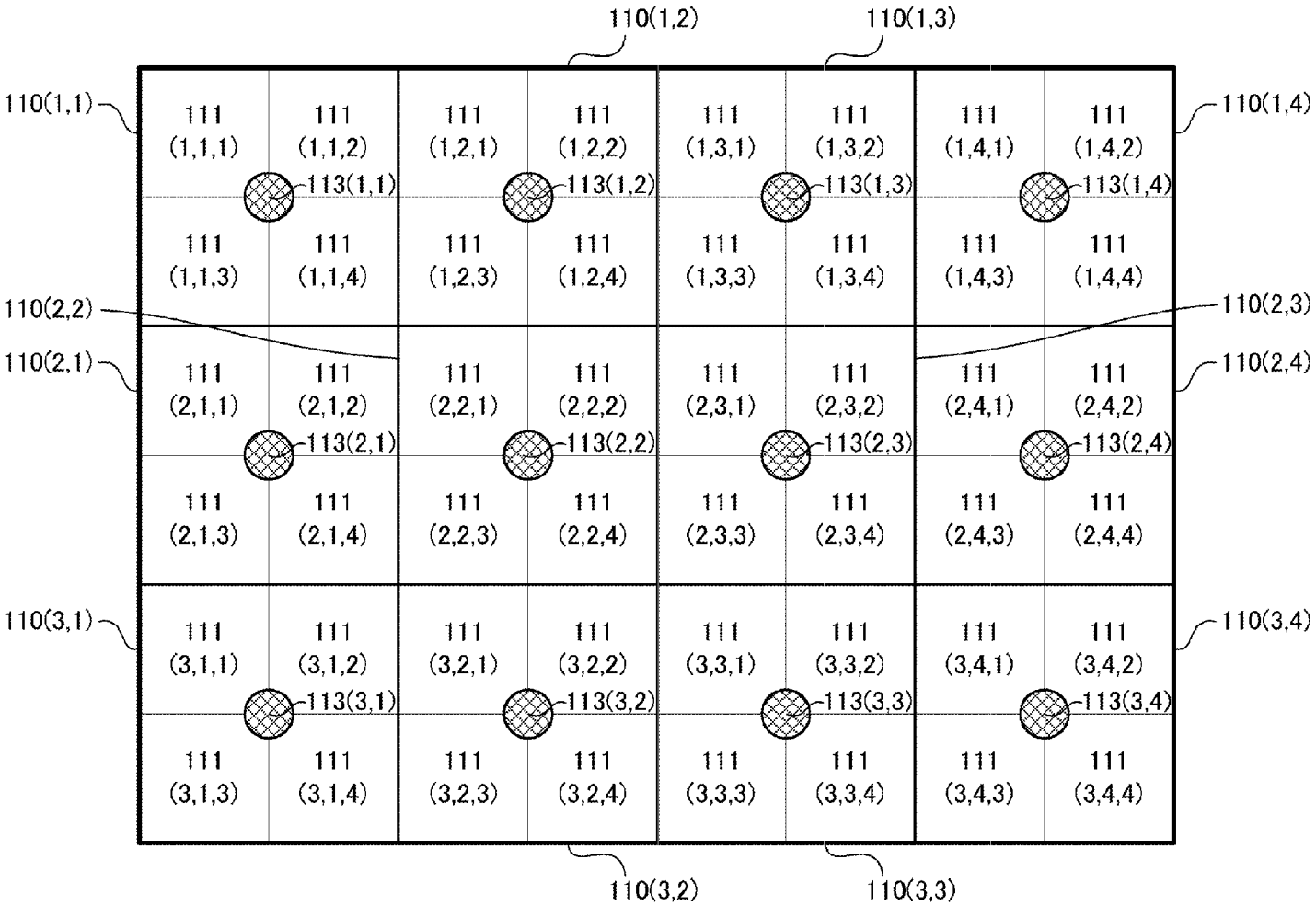
FIG. 13 is a construction view of an LED backlight apparatus according to a second embodiment of the present invention.

FIG. 13 is a schematic view showing an example of the arrangement of LED boards 110, light emission blocks 111 and optical sensors 113 in an LED backlight apparatus 101, when seen from a front direction (i.e., from a side of a color liquid crystal panel 105). An LED board 110 (1, 1) is arranged at an upper left end of the LED backlight apparatus 101, and an LED board 110 (1, 2), an LED board 110 (1, 3) and an LED board 110 (1, 4) are arranged in order in a lateral or horizontal right direction of the LED board 110 (1, 1). In addition, an LED board 110 (2, 1) and an LED board 110 (3, 1) are arranged in order in a longitudinal or vertical downward direction of the LED board 110 (1, 1). Similarly, an LED board 110 (2, 2) and an LED board 110 (3, 2) are arranged in order in a longitudinal or vertical downward direction of the LED board 110 (1, 2); an LED board 110 (2, 3) and an LED board 110 (3, 3) are arranged in order in a longitudinal or vertical downward direction of the LED board 110 (1, 3); and an LED board 110 (2, 4) and an LED board 110 (3, 4) are arranged in order in a longitudinal or vertical downward direction of the LED board 110 (1, 4). As mentioned above, the LED backlight apparatus 101 of this second embodiment is constructed of a total of twelve LED boards 110, which are arranged in a 4×3 matrix form (i.e., 4 columns (in the horizontal direction) by 3 rows (in the vertical direction)).

The LED board 110 (1, 1) is composed of a light emission block 111 (1, 1, 1), a light emission block 111 (1, 1, 2), a light emission block 111 (1, 1, 3), a light emission block 111 (1, 1, 4), and an optical sensor 113 (1, 1). Each of the other LED boards 110 (1, 2) through 110 (1, 4), 110 (2, 1) through 110 (2, 4), 110 (3, 1) through 110 (3, 4) and 110 (4, 1) through 110 (4, 4) has the same construction as that of the LED board 110 (1, 1) (refer to FIG. 13).

FIG. 14 is a correspondence table showing an example of the order of detection of the individual light emission blocks 111 and grouping or combination of light emission blocks 111 which are caused to turn on at the same time at each turn of detection. Brightness detection of the individual light emission blocks 111 is carried out according to the order of detection 500. The order of detection 500 is decided from the 1st to the 24th, and at each turn of the order of detection 500, a total of two light emission blocks 111 including a light emission block A501 and a light emission block B503 are caused to turn on at the same time. In addition, brightness detection of the light emission blocks 111 is carried out by the use of an optical sensor 502 for detection of light emission blocks A, and an optical sensor 504 for detection of light emission blocks B. That is, an optical sensor 502 for detection of light emission blocks A detects, as objects to be detected, light emission blocks 111 of a group of light emission blocks A501, and an optical sensor 504 for detection of light emission blocks B detects, as objects to be detected, light emission blocks 111 of a group of light emission blocks B503. An optical sensor 113 which is provided on an LED board 110 to which light emission blocks 111 belong is an optical sensor 113 which detects those light emission blocks 111 as objects to be detected. That is, an optical sensor 113 (L, M) detects light emission blocks 111 (L, M, K) as objects to be detected (here, L=1-3, M=1–4, K=1-4). However, detection errors will occur because lights emitted from light emission blocks 111 other than alight emission block 111 which is assumed to be detected by a corresponding optical sensor 113 enter each optical sensor 113 as leakage light. Such a situation is the same as that in the above-mentioned first embodiment. A method of deciding a pair of light emission blocks 111 which are caused to emit light at the same time so as to make such detection errors small will be explained hereinafter.

Here, groups of light emission blocks, which are arranged in the left half of the LED backlight apparatus 101 when seen from a front direction (from the side of the color liquid crystal panel 105), are assigned as groups of light emission blocks A501, which are a first light emission block group. In addition, groups of light emission blocks, which are arranged in the right half of the LED backlight apparatus 101, are assigned as groups of light emission blocks B503, which are a second light emission block group.

For example, in the first of the order of detection 500, a total of two light emission blocks 111, i.e., the light emission block 111 (1, 1, 1) as a light emission block A501 and the light emission block 111 (1, 3, 2) as a light emission block B503, are caused to turn on at the same time. In addition, brightness detection is carried out by using the optical sensor 113 (1, 1) as an optical sensor 502 for detection of light emission blocks A, and the optical sensor 113 (1, 3) as an optical sensor 504 for detection of light emission blocks B, respectively.

The set or combination of a light emission block A501 and a light emission block B503, which are caused to turn on at the same time at each turn of the order of detection 500, is decided in such a manner that a minimum value of a detection value ratio $R_V$ of each light emission block 111 in the entire backlight apparatus 101 becomes more larger. A decision procedure for such a combination will be described hereafter.

Figure 15:
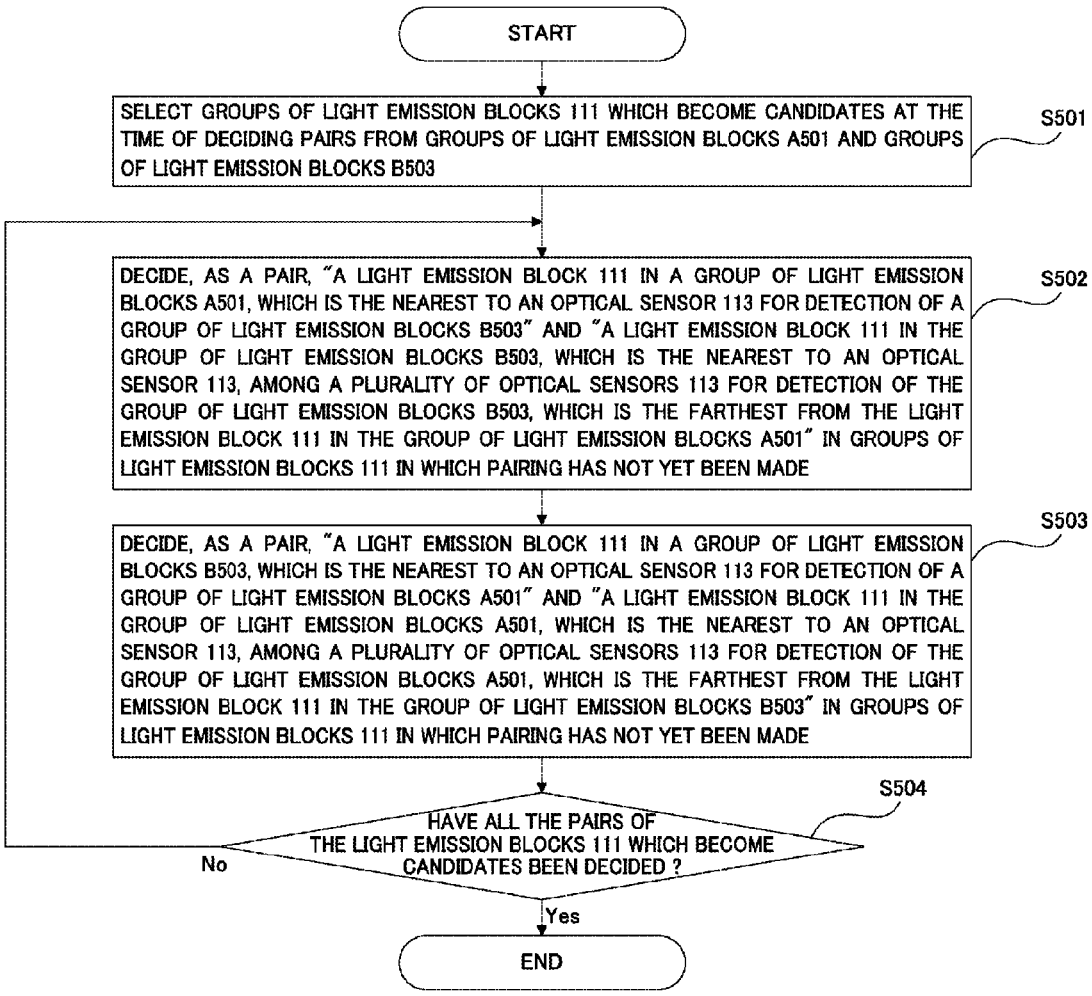
FIG. 15 shows an example of a flowchart showing a procedure to decide pairs of light emission blocks according to the second embodiment of the present invention.

FIG. 15 is an example of a flow chart showing a procedure to decide combinations (pairs) of light emission blocks. First, in step S501, groups of light emission blocks 111 which become candidates at the time of deciding pairs are selected from groups of light emission blocks A501 and groups of light emission blocks B503.

Figure 16:
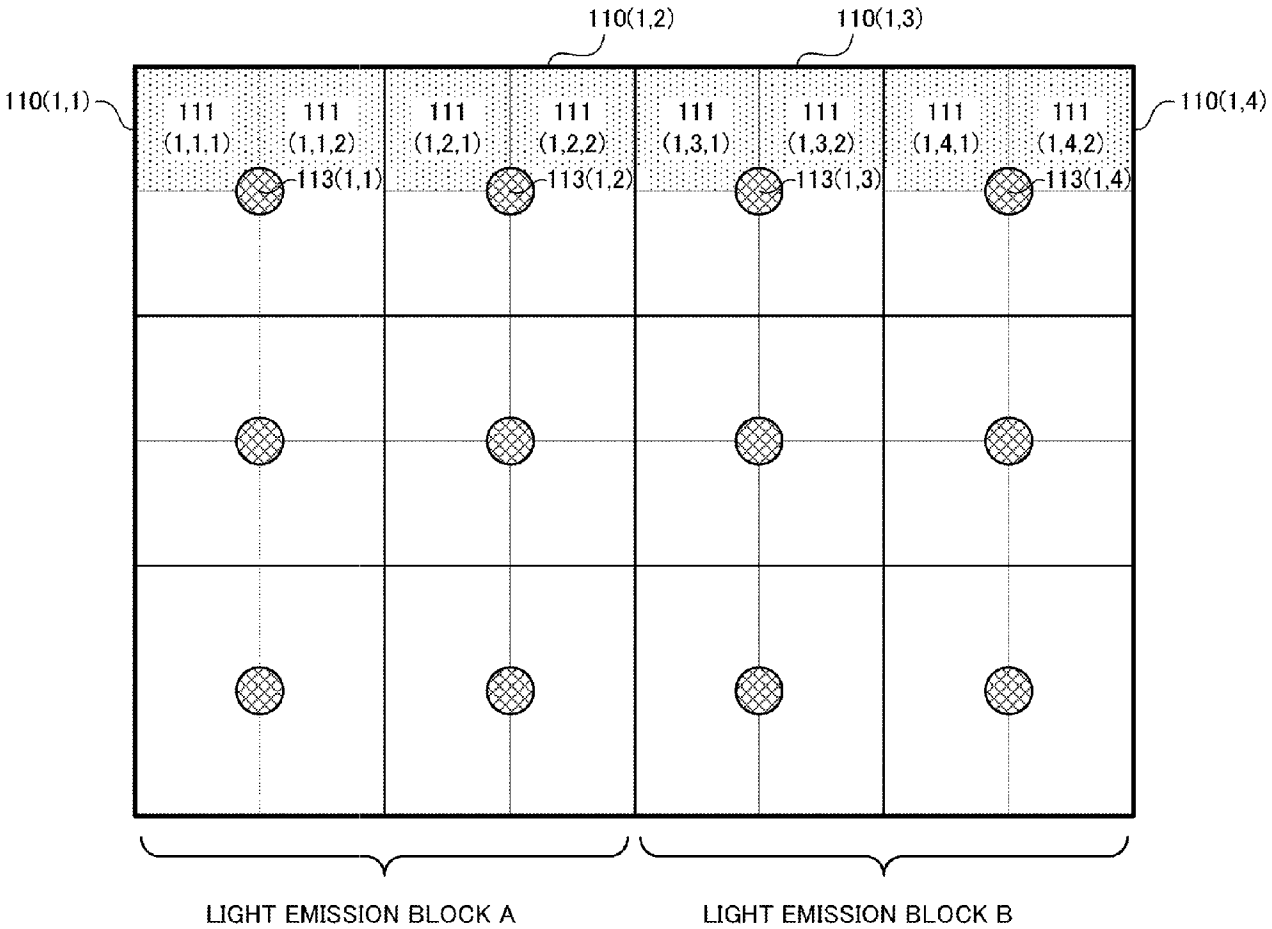
FIG. 16 is a view showing an example of light emission block groups which become candidates for deciding pairs in the second embodiment of the present invention.

FIG. 16 is a schematic view showing an example of groups of light emission blocks 111 which have been selected in step S501. As explained before, when looking at the LED backlight apparatus 101 from its front direction (from the side of the color liquid crystal panel 105), groups of light emission blocks lying in the left half thereof are assigned as the groups of light emission blocks A501, and groups of light emission blocks lying in the right half thereof are assigned as the groups of light emission blocks B503. From among these, light emission blocks 111 at the first row from the upper end are selected as groups of light emission blocks 111 which become candidates at the time of deciding pairs. Specifically, four of the light emission block 111 (1, 1, 1), the light emission block 111 (1, 1, 2), the light emission block 111 (1, 2, 1), and the light emission block 111 (1, 2, 2) are selected from the groups of light emission blocks A501. In addition, four of the light emission block 111 (1, 3, 1), the light emission block 111 (1, 3, 2), the light emission block 111 (1, 4, 1), and the light emission block 111 (1, 4, 2) are selected from the groups of light emission blocks B503. Here, brightness detection of the four light emission blocks 111 in the groups of the light emission blocks A501, which are the first light emission block group, is carried out by two optical sensors (i.e., the optical sensor 113 (1, 1) and the optical sensor 113 (1, 2)) which are a first detection unit group corresponding to the first light emission block group. In addition, brightness detection of the four light emission blocks 111 in the groups of the light emission blocks B503, which are the second light emission block group, is carried out by two optical sensors (i.e., the optical sensor 113 (1, 3) and the optical sensor 113 (1, 4)) which are a second detection unit group corresponding to the second light emission block group.

Then, in step S502 in FIG. 15, in those groups of light emission blocks 111 in which pairing has not yet been made, among the groups of light emission blocks 111 selected in step S501, (1) a light emission block 111 in a group of light emission blocks A501, which is the nearest to an optical sensor 113 for detection of a group of light emission blocks B503, and (2) a light emission block 111 in the group of light emission blocks B503, which is the nearest to an optical sensor 113, among a plurality of optical sensors 113 for detection of the group of light emission blocks B503, which is the farthest from the light emission block 111 in the group of light emission blocks A501, are decided as a pair.

Figure 17A:
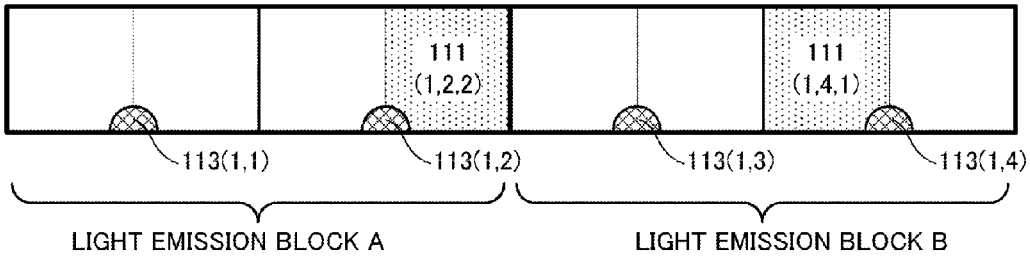
FIGS. 17A through 17D are views showing examples of pairs of light emission blocks to be decided, respectively, in the second embodiment of the present invention.

FIG. 17A is a schematic view showing an example of light emission blocks 111 which have been decided as a pair in step S502. The light emission block 111 (1, 2, 2) is selected from the group of light emission blocks A501, and the light emission block 111 (1, 4, 1) is selected from the group of light emission blocks B503. Here, the light emission block 111 (1, 4, 2) may instead be selected from the group of light emission blocks B503.

Thereafter, in step S503 in FIG. 15, in those groups of light emission blocks 111 in which pairing has not yet been made, among the groups of light emission blocks 111 selected in step S501, (1) a light emission block 111 in a group of light emission blocks B503, which is the nearest to an optical sensor 113 for detection of a group of light emission blocks A501, and (2) a light emission block 111 in the group of light emission blocks A501, which is the nearest to an optical sensor 113, among a plurality of optical sensors 113 for detection of the group of light emission blocks A501, which is the farthest from the light emission block 111 in the group of light emission blocks B503, are decided as a pair.

Figure 17B:
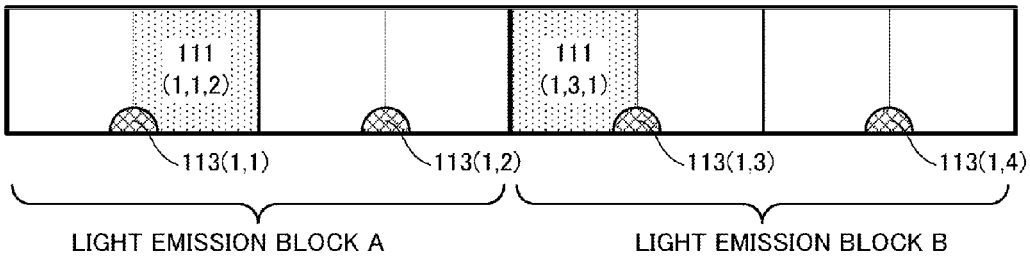

FIG. 17B is a schematic view showing an example of light emission blocks 111 which have been decided as a pair in step S503. The light emission block 111 (1, 3, 1) is selected from the group of light emission blocks B503, and the light emission block 111 (1, 1, 2) is selected from the group of light emission blocks A501. Here, the light emission block 111 (1, 1, 1) may instead be selected from the group of light emission blocks A501.

Then, in step S504 of FIG. 15, it is determined whether all the pairs of the light emission blocks 111 which become candidates have been decided. In cases where all the pairs of the light emission blocks 111 which become candidates have been decided, the procedure of this flow chart is all completed, but in cases where they have not yet been decided, a return is again made to step S502.

Figure 17C:
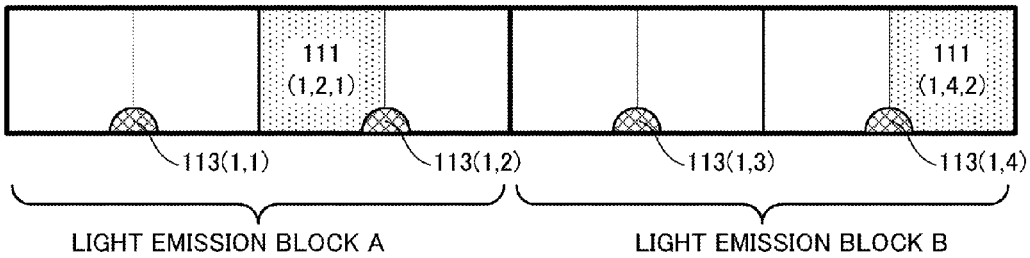

FIG. 17C is a schematic view showing an example of light emission blocks 111 which have been decided as a pair in step S502 of a second round. The light emission block 111 (1, 2, 1) is selected from the group of light emission blocks A501, and the light emission block 111 (1, 4, 1) is selected from the group of light emission blocks B503.

Figure 17D:
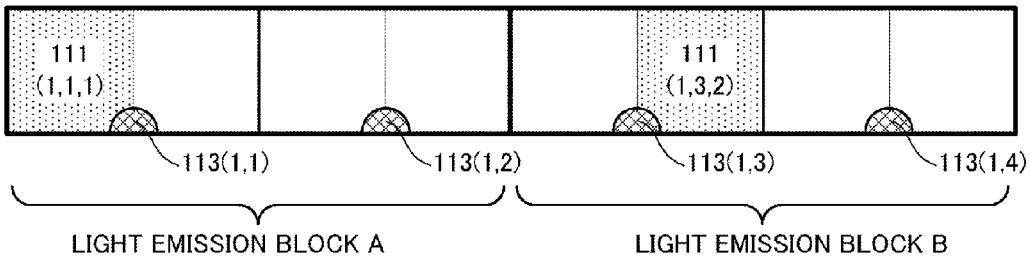

FIG. 17D is a schematic view showing an example of light emission blocks 111 which have been decided as a pair in step S503 of the second round. Here, there is only one light emission block 111 which has not yet been decided as a pair, in each of the group of light emission blocks A501 and the group of light emission blocks B503, and hence, there is no combination which makes a pair, other than a combination of the light emission block 111 (1, 1, 1) and the light emission block 111 (1, 3, 2).

As described above, this second embodiment can be applied, even in cases where the number of optical sensors with respect to the number of the light emission blocks is different from that in the first embodiment. As a result of this, the brightnesses of a plurality of light emission blocks 111 are detected at the same time by the use of a plurality of optical sensors 113 in a state where the plurality of light emission blocks 111 are caused to turn on at the same time. At that time, detection errors will occur because lights emitted by light emission blocks 111 other than a light emission block 111 which is to be detected by a corresponding optical sensor 113 enter each optical sensor 113 as leakage light. However, it is possible to carry out calibration by causing a plurality of light emission blocks 111 to emit light at the same time in a combination thereof which can make such detection errors as small as possible. Accordingly, accurate calibration can be carried out, thus making it possible to suppress brightness unevenness in an effective manner.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-080967, filed on Mar. 30, 2012, which is hereby incorporated by reference herein in its entirety.

What is claimed is:

1. A lighting apparatus comprising:

a plurality of light emission block groups composed of a plurality of light emission blocks, the emissions of light of which are able to be controlled independently of one another; and a detection unit that is provided for each of said light emission block groups, and detects a light emission characteristic of each of light emission blocks which belong to the corresponding light emission block group;

wherein said plurality of light emission blocks are grouped in such a manner that sets of light emission blocks are formed, each one of which is selected from a plurality of different light emission block groups, with all said light emission blocks being included in any of the sets;

an obtaining unit is provided which carries out control on all the sets in a sequential manner, such that a plurality of light emission blocks belonging to a same set are caused to emit light at the same time, and a light emission characteristic of each of those light emission blocks which are caused to emit light at the same time is obtained by a detection unit corresponding to a light emission block group to which each of the light emission blocks emitting light at the same time belongs; and said grouping is decided in such a manner that a minimum value, in all the sets, of a detection value ratio becomes as large as possible, wherein the detection value ratio is a ratio between an amount of light, of the total amount of light which is received by each of said detection units at the time when the plurality of light emission blocks belonging to the same set emit light at the same time, due to an emission of light from a light emission block belonging to a light emission block group corresponding to each of said detection units, and an amount of light, of said total amount of light, due to an emission of light from another light emission block which emits light simultaneously with said light emission block.

2. A lighting apparatus comprising:

a plurality of light emission block groups composed of a plurality of light emission blocks, the emissions of light of which are able to be controlled independently of one another; and a detection unit group that is provided for each of said light emission block groups, and is composed of a plurality of detection units for detecting light emission characteristics of light emission blocks which belong to the corresponding light emission block group;

wherein said plurality of light emission blocks are grouped in such a manner that sets of light emission blocks are formed, each one of which is selected from a plurality of different light emission block groups, with all said light emission blocks being included in any of the sets;

an obtaining unit is provided which carries out control on all the sets in a sequential manner, such that a plurality of light emission blocks belonging to a same set are caused to emit light at the same time, and a light emission characteristic of each of those light emission blocks which are caused to emit light at the same time is obtained by a detection unit which is the nearest to said light emission block, among a plurality of detection units belonging to a detection unit group corresponding to a light emission block group to which each of the light emission blocks emitting light at the same time belongs; and said grouping is decided in such a manner that a minimum value, in all the sets, of a detection value ratio becomes as large as possible, wherein the detection value ratio is a ratio between an amount of light, of a total amount of light which is received by each of said detection units, at the time when the plurality of light emission blocks belonging to the same set emit light at the same time, due to an emission of light from a light emission block belonging to a light emission block group corresponding to each of said detection units, and an amount of light, of said total amount of light, due to an emission of light from another light emission block which emits light simultaneously with said light emission block.

3. The lighting apparatus as set forth in claim 1, further comprising:

a first light emission block group and a second light emission block group that are each composed of a plurality of light emission blocks;

a first detection unit for detecting the light emission characteristic of each of light emission blocks which belong to said first light emission block group; and a second detection unit for detecting the light emission characteristic of each of light emission blocks which belong to said second light emission block group;

wherein the light emission blocks belonging to said each set comprise two light emission blocks, one of which is selected from said first light emission block group, and the other of which is selected from said second light emission block group;

said obtaining unit carries out control on all the sets in a sequential manner, such that two light emission blocks belonging to a same set are caused to emit light at the same time, whereby the light emission characteristic of a light emission block belonging to said first light emission block group is obtained by said first detection unit, and the light emission characteristic of a light emission block belonging to said second light emission block group is obtained by said second detection unit; and said grouping is decided by repeating, until all the light emission blocks are included in any set, at least either one of a first procedure (1) in which a light emission block, among the light emission blocks belonging to said first light emission block group, which is the nearest to said second detection unit, and a light emission block, among the light emission blocks belonging to said second light emission block group, which is the nearest to said second detection unit, are decided as a set, and a second procedure (2) in which a light emission block, among the light emission blocks belonging to said first light emission block group, which is the nearest to said first detection unit, and a light emission block, among the light emission blocks belonging to said second light emission block group, which is the nearest to said first detection unit, are decided as a set.

4. The lighting apparatus as set forth in claim 2, further comprising:

a first light emission block group and a second light emission block group that are each composed of a plurality of light emission blocks;

a first detection unit group composed of a plurality of detection units for detecting the light emission characteristics of light emission blocks which belong to said first light emission block group; and a second detection unit group composed of a plurality of detection units for detecting the light emission characteristics of light emission blocks which belong to said second light emission block group;

wherein the light emission blocks belonging to said each set comprise two light emission blocks, one of which is selected from said first light emission block group, and the other of which is selected from said second light emission block group;

said obtaining unit carries out control on all the sets in a sequential manner, such that two light emission blocks belonging to a same set are caused to emit light at the same time, whereby the light emission characteristic of a light emission block belonging to said first light emission block group is obtained by a detection unit which is the nearest to said light emission block, among the plurality of detection units belonging to said first detection unit group, and the light emission characteristic of a light emission block belonging to said second light emission block group is obtained by a detection unit which is the nearest to said light emission block, among the plurality of detection units belonging to said second detection unit group; and said grouping is decided by repeating, until all the light emission blocks are included in any set, at least either one of a first procedure (1) in which a light emission block, among the light emission blocks belonging to said first light emission block group, which is the nearest to said second detection unit group, and a light emission block, among the light emission blocks belonging to said second light emission block group, which is the nearest to a detection unit, among the plurality of detection units belonging to said second detection unit group, which is located at the farthest from said first light emission block group, are decided as a set, and a second procedure (2) in which a light emission block, among the light emission blocks belonging to said first light emission block group, which is the nearest to a detection unit, among the plurality of detection units belonging to said first detection unit group, which is located at the farthest from said second light emission block group, and a light emission block, among the light emission blocks belonging to said second light emission block group, which is the nearest to said first detection unit group, are decided as a set.

5. The lighting apparatus as set forth in claim 1, further comprising:

a calibration unit configured to correct an amount of light emission of each light emission block based on a result of a comparison between a detected value of a light emission characteristic thereof obtained by said obtaining unit and a target value thereof.

6. The lighting apparatus as set forth in claim 1, wherein said detection units each detect at least either brightness or chromaticity as the light emission characteristic of a light emission block.

7. A calibration method for a lighting apparatus which includes:

a plurality of light emission block groups composed of a plurality of light emission blocks, the emissions of light of which are able to be controlled independently of one another; and a detection unit that is provided for each of said light emission block groups, and detects a light emission characteristic of each of light emission blocks which belong to the corresponding light emission block group;

wherein said plurality of light emission blocks are grouped in such a manner that sets of light emission blocks are formed, each one of which is selected from a plurality of different light emission block groups, with all said light emission blocks being included in any of the sets;

said method comprising:

an obtaining step to carry out control on all the sets in a sequential manner, such that a plurality of light emission blocks belonging to a same set are caused to emit light at the same time, and a light emission characteristic of each of those light emission blocks which are caused to emit light at the same time is obtained by a detection unit corresponding to a light emission block group to which each of the light emission blocks emitting light at the same time belongs; and a calibration step to correct an amount of light emission of each light emission block based on a result of a comparison between a detected value of a light emission characteristic thereof obtained in said obtaining step and a target value thereof;

wherein said grouping is decided in such a manner that a minimum value, in all the sets, of a detection value ratio becomes as large as possible, wherein the detection value ratio is a ratio between an amount of light, of the total amount of light which is received by each of said detection units at the time when the plurality of light emission blocks belonging to the same set emit light at the same time, due to an emission of light from a light emission block belonging to a light emission block group corresponding to each of said detection units, and an amount of light, of said total amount of light, due to an emission of light from another light emission block which emits light simultaneously with said light emission block.

8. A calibration method for a lighting apparatus which includes:

a plurality of light emission block groups composed of a plurality of light emission blocks, the emissions of light of which are able to be controlled independently of one another; and a detection unit group that is provided for each of said light emission block groups, and is composed of a plurality of detection units for detecting light emission characteristics of light emission blocks which belong to the corresponding light emission block group;

wherein said plurality of light emission blocks are grouped in such a manner that sets of light emission blocks are formed, each one of which is selected from a plurality of different light emission block groups, with all said light emission blocks being included in any of the sets;

said method comprising:

an obtaining step to carry out control on all the sets in a sequential manner, such that a plurality of light emission blocks belonging to a same set are caused to emit light at the same time, and a light emission characteristic of each of those light emission blocks which are caused to emit light at the same time is obtained by a detection unit which is the nearest to said light emission block, among a plurality of detection units belonging to a detection unit group corresponding to a light emission block group to which each of the light emission blocks emitting light at the same time belongs; and a calibration step to correct an amount of light emission of each light emission block based on a result of a comparison between a detected value of a light emission characteristic thereof obtained in said obtaining step and a target value thereof;

wherein said grouping is decided in such a manner that a minimum value, in all the sets, of a detection value ratio becomes as large as possible, wherein the detection value ratio is a ratio between an amount of light, of a total amount of light which is received by each of said detection units, at the time when the plurality of light emission blocks belonging to the same set emit light at the same time, due to an emission of light from a light emission block belonging to a light emission block group corresponding to each of said detection units, and an amount of light, of said total amount of light, due to an emission of light from another light emission block which emits light simultaneously with said light emission block.

9. The calibration method for the lighting apparatus as set forth in claim 7, the lighting apparatus further comprising:

a first light emission block group and a second light emission block group that are each composed of a plurality of light emission blocks;

a first detection unit for detecting the light emission characteristic of each of light emission blocks which belong to said first light emission block group; and a second detection unit for detecting the light emission characteristic of each of light emission blocks which belong to said second light emission block group;

wherein the light emission blocks belonging to said each set comprise two light emission blocks, one of which is selected from said first light emission block group, and the other of which is selected from said second light emission block group;

in said obtaining step, it is carried out control on all the sets in a sequential manner, such that two light emission blocks belonging to a same set are caused to emit light at the same time, whereby the light emission characteristic of a light emission block belonging to said first light emission block group is obtained by said first detection unit, and the light emission characteristic of a light emission block belonging to said second light emission block group is obtained by said second detection unit; and said grouping is decided by repeating, until all the light emission blocks are included in any set, at least either one of a first procedure (1) in which a light emission block, among the light emission blocks belonging to said first light emission block group, which is the nearest to said second detection unit, and a light emission block, among the light emission blocks belonging to said second light emission block group, which is the nearest to said second detection unit, are decided as a set, and a second procedure (2) in which a light emission block, among the light emission blocks belonging to said first light emission block group, which is the nearest to said first detection unit, and a light emission block, among the light emission blocks belonging to said second light emission block group, which is the nearest to said first detection unit, are decided as a set.

10. The calibration method for the lighting apparatus as set forth in claim 8, the lighting apparatus further comprising:

a first light emission block group and a second light emission block group that are each composed of a plurality of light emission blocks;

a first detection unit group composed of a plurality of detection units for detecting the light emission characteristics of light emission blocks which belong to said first light emission block group; and a second detection unit group composed of a plurality of detection units for detecting the light emission characteristics of light emission blocks which belong to said second light emission block group;

wherein the light emission blocks belonging to said each set comprise two light emission blocks, one of which is selected from said first light emission block group, and the other of which is selected from said second light emission block group;

in said obtaining step, it is carried out control on all the sets in a sequential manner, such that two light emission blocks belonging to a same set are caused to emit light at the same time, whereby the light emission characteristic of a light emission block belonging to said first light emission block group is obtained by a detection unit which is the nearest to said light emission block, among the plurality of detection units belonging to said first detection unit group, and the light emission characteristic of a light emission block belonging to said second light emission block group is obtained by a detection unit which is the nearest to said light emission block, among the plurality of detection units belonging to said second detection unit group; and said grouping is decided by repeating, until all the light emission blocks are included in any set, at least either one of a first procedure (1) in which a light emission block, among the light emission blocks belonging to said first light emission block group, which is the nearest to said second detection unit group, and a light emission block, among the light emission blocks belonging to said second light emission block group, which is the nearest to a detection unit, among the plurality of detection units belonging to said second detection unit group, which is located at the farthest from said first light emission block group, are decided as a set, and a second procedure (2) in which a light emission block, among the light emission blocks belonging to said first light emission block group, which is the nearest to a detection unit, among the plurality of detection units belonging to said first detection unit group, which is located at the farthest from said second light emission block group, and a light emission block, among the light emission blocks belonging to said second light emission block group, which is the nearest to said first detection unit group, are decided as a set.

11. The calibration method for the lighting apparatus as set forth in claim 7, wherein said detection units each detect at least either brightness or chromaticity as the light emission characteristic of a light emission block.

* * * * *